US006578717B2

(12) United States Patent
Pickett

(10) Patent No.: US 6,578,717 B2
(45) Date of Patent: Jun. 17, 2003

(54) ECONOMICAL DESKTOP BOOKCASE

(76) Inventor: Thomas C. Pickett, 8135 Independence, Sterling Heights, MI (US) 48313

( * ) Notice: Subject to any disclaimer, the term of this patent is extended or adjusted under 35 U.S.C. 154(b) by 0 days.

(21) Appl. No.: 09/967,559

(22) Filed: Sep. 29, 2001

(65) Prior Publication Data

US 2003/0062327 A1 Apr. 3, 2003

(51) Int. Cl.[7] ..... A47B 65/00
(52) U.S. Cl. ..... 211/42; 211/149; D19/34.1
(58) Field of Search ..... 211/42, 43, 132.1, 211/149, 73, 135; D19/34.1

(56) References Cited

U.S. PATENT DOCUMENTS

| | | | | | |
|---|---|---|---|---|---|
| 1,270,718 | A | * | 6/1918 | Ford | |
| 1,477,634 | A | * | 12/1923 | Connor | |
| 1,723,944 | A | * | 8/1929 | Marsh | |
| 1,729,014 | A | * | 9/1929 | Scherotto | |
| 1,791,196 | A | | 2/1931 | Deutschmeister | |
| 2,118,821 | A | | 5/1938 | Ringler | |
| 2,391,285 | A | * | 12/1945 | Williamson et al. | |
| 2,996,175 | A | | 8/1961 | Frankenstein | 206/45 |
| 3,592,344 | A | * | 7/1971 | Schade | 211/42 |
| 3,692,174 | A | * | 9/1972 | Ross | |
| 3,865,233 | A | | 2/1975 | Hamlin | 206/45.19 |
| 4,088,262 | A | | 5/1978 | Kuehlhorn | 229/27 |
| 4,236,662 | A | | 12/1980 | Roccaforte | 229/39 B |
| 4,285,150 | A | | 8/1981 | Richardson | 40/312 |
| 4,488,675 | A | | 12/1984 | Gnechten | 229/33 |
| 4,618,090 | A | | 10/1986 | Cortellucci | 229/45 R |
| RE32,668 | E | * | 5/1988 | Smith | 211/73 X |
| 4,919,269 | A | | 4/1990 | Wright | 206/602 |
| 5,213,220 | A | * | 5/1993 | McBride | 211/132.1 |
| 5,326,017 | A | | 7/1994 | Liu | 229/120.17 |
| 5,332,148 | A | | 7/1994 | Liu | 229/120.17 |
| 5,588,583 | A | | 12/1996 | Cargile | 229/120.17 |
| 5,938,109 | A | | 8/1999 | Sainz | 229/120.21 |
| 6,237,842 | B1 | | 5/2001 | Nguyen | 229/120.21 |

* cited by examiner

*Primary Examiner*—Robert W. Gibson, Jr.
(74) *Attorney, Agent, or Firm*—George F. Helfrich

(57) ABSTRACT

An inexpensive, portable desktop bookcase is an open-sided carton suitable for holding a small number of books. The desktop bookcase allows the books to be portably stored together on the desktop, conveniently accessible, removable and replaceable. The bookcase carton is formed from folding a two-dimensional production blank, resulting in a storage unit which is suitable for its desktop purpose, as well as for transporting books from one location to another.

12 Claims, 21 Drawing Sheets

ECONOMICAL DESKTOP BOOKCASE

BACKGROUND OF THE INVENTION

1. Field of the Invention

The subject invention relates generally to three-dimensional containers, and relates more particularly to an economical open-sided carton which serves as a convenient desktop book storage unit. The invention is specifically directed to a one-piece, two dimensional production blank, which can be folded into such a storage unit.

2. Description of the Related Art

Art dated as early as the 1930s describes three-dimensional containers, boxes, display cases, and other types of cartons of various shapes, sizes, configurations, and purposes, formed from two-dimensional foldable blanks. Such art provides a variety of features, including protective coatings, multiple storage compartments, hinged tops, multi-thickness wall structure for enhanced stacking capability, interior channel and box beam structural enforcement, and exterior apertures for receiving insert labels.

A wide variety of patents have been granted for these cartons of many sizes, shapes, configurations, and uses produced by folding two-dimensional blanks. It is generally quite non-obvious from the two-dimensional blank how the resulting carton will look, or what its particular function or qualities may be. In addition, a wide variety of such foldable blanks, and the resulting cartons, have been considered novel, perhaps due to the fact that brand new two-dimensional blank geometries have been designed, leading to new forms of cartons and containers with functionally appropriate structure and features.

Like the foldable blanks from which such cartons are produced, two-dimensional, foldable paper book covers are also available for adapting to books of various dimensions. Such book covers are very inexpensive, readily available in the consumer marketplace, and are often colorfully decorated either by the manufacturer or by the consumer.

Standard bookcases are commonplace as fixed storage units for books in the home or office. Such bookcases vary in size, but are typically built of rigid structural materials like wood or metal, large enough to accommodate many books, and often cumbersome to move, especially when filled with books. Conversely, bookends are available to hold a small number of books on a desktop, but bookends tend to slide apart, allowing the books to fall over, especially when one or more books is removed.

A product which is not yet in existence is a small, inexpensive, portable desktop bookcase, which could be purchased as a two-dimensional blank, folded into a suitable open-sided book storage unit, decorated to suit the consumer, and employed to securely hold a small number of books on the desktop, as well as to carry the books from place to place when transportation becomes necessary.

BRIEF SUMMARY OF THE INVENTION

Accordingly, it is an object of the present invention to provide an open-sided carton which serves as a convenient desktop book storage unit.

It is another object of the invention to provide a book storage unit which is inexpensive, easy to assemble, portable, and small enough to fit on a desk.

It is additionally an object of the invention to provide a carton of this character formed from a single blank of suitable cardboard or like material, foldable to form a simple, strong, economical and practical book storage unit for the purpose described.

These and other objects of the present invention will become more readily appreciated and understood from a consideration of the following detailed description of the exemplary embodiment, when taken together with the accompanying drawings.

The subject invention is an inexpensive, portable desktop bookcase. The bookcase consists of an open-sided carton suitable for holding a small number of books, so that they are kept together on the desktop, conveniently accessible, removable and replaceable. The carton is formed from folding a two-dimensional production blank, resulting in a storage unit which is suitable for its desktop purpose, as well as for transporting books from one location to another. Further design features include structural stiffeners, button-hole flap assembly, adhesives, and accommodations for individual decoration and personalization (e.g. by children). Likewise, further applications include the storage of compact disks (e.g. for music or computer software), kitchen spices, garage containers (e.g. boxes of nails), cassette tapes, video cassette recorder videotapes, or other objects of similar size and shape. The carton can also serve as an open display case for these types of items, or other items of like dimensions.

DETAILED DESCRIPTION OF THE INVENTION

The subject invention is an inexpensive, portable desktop bookcase. The bookcase consists of an open-sided carton suitable for holding a small number of books, so that they are kept together on the desktop, conveniently accessible, removable and replaceable. The carton is formed from folding a two-dimensional production blank, resulting in a storage unit which is suitable for its desktop purpose, as well as for transporting books from one location to another. Further applications of the subject invention include the storage of compact disks (e.g. for music or computer software), kitchen spices, garage containers (e.g. boxes of nails), cassette tapes, video cassette recorder videotapes, or other objects of similar size and shape. The carton can also serve as an open display case for these types of items, or other items of like dimensions.

A number of variations on the subject invention may be envisioned by one practiced in the art of simple mechanical design. A few examples of embodiments envisioned by the inventor are described in this specification. Although all the embodiments described herein represent desktop bookcases formed from folding two-dimensional blanks, a number of variations on design are depicted. Design variation features include structural stiffeners, button-hole or tab flap assembly, adhesives, provisions for individual decoration or personalization (e.g. by children), and the capability of combining the subject invention with a typical set of metal bookends. Variations which improve the ease of assembly are also envisioned, and should be considered within the scope of the present invention. Such variations include the creasing of foldlines to improve the ability to fold cardboard, plastic, or other materials, double (parallel) foldlines to allow a cardboard or plastic flap to be more easily folded over an existing cardboard or plastic thickness, tabs and slots to facilitate the assembly of the folded structure, and adhesives for ensuring that the assembled unit maintains its configuration.

EXAMPLE 1

Figure 1:
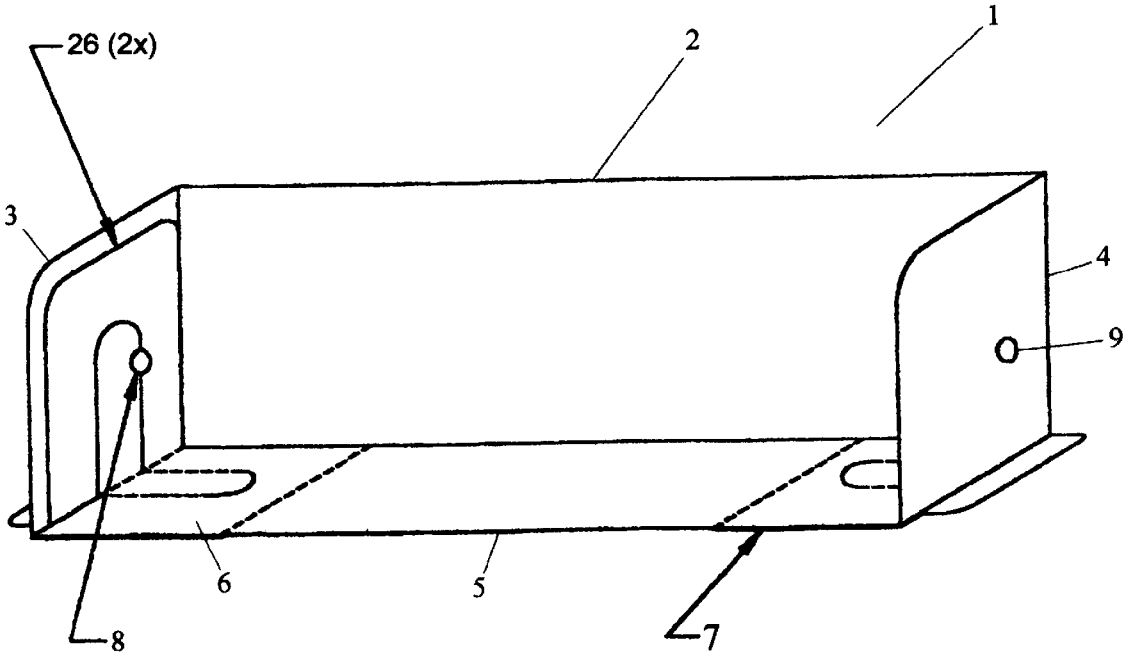
FIG. 1 is a depiction of one embodiment of the present invention with snap buttons, configured for use in combination with pre-existing bookends.

FIG. 1 illustrates a simple embodiment in which the subject invention is configured to be combined with typical metal bookends 26, so that the subject invention provides stability for the bookends 26, and the bookends 26 add structural strength to the invention. Basic bookcase 1 is a rectangular unit with an open front and open top, a vertical rear flap 2, vertical left side flap 3 and right side flap 4, bottom flap 5, left cardboard doubler 6 and right cardboard doubler 7, and left snap button 8 and right snap button 9.

Figure 2:
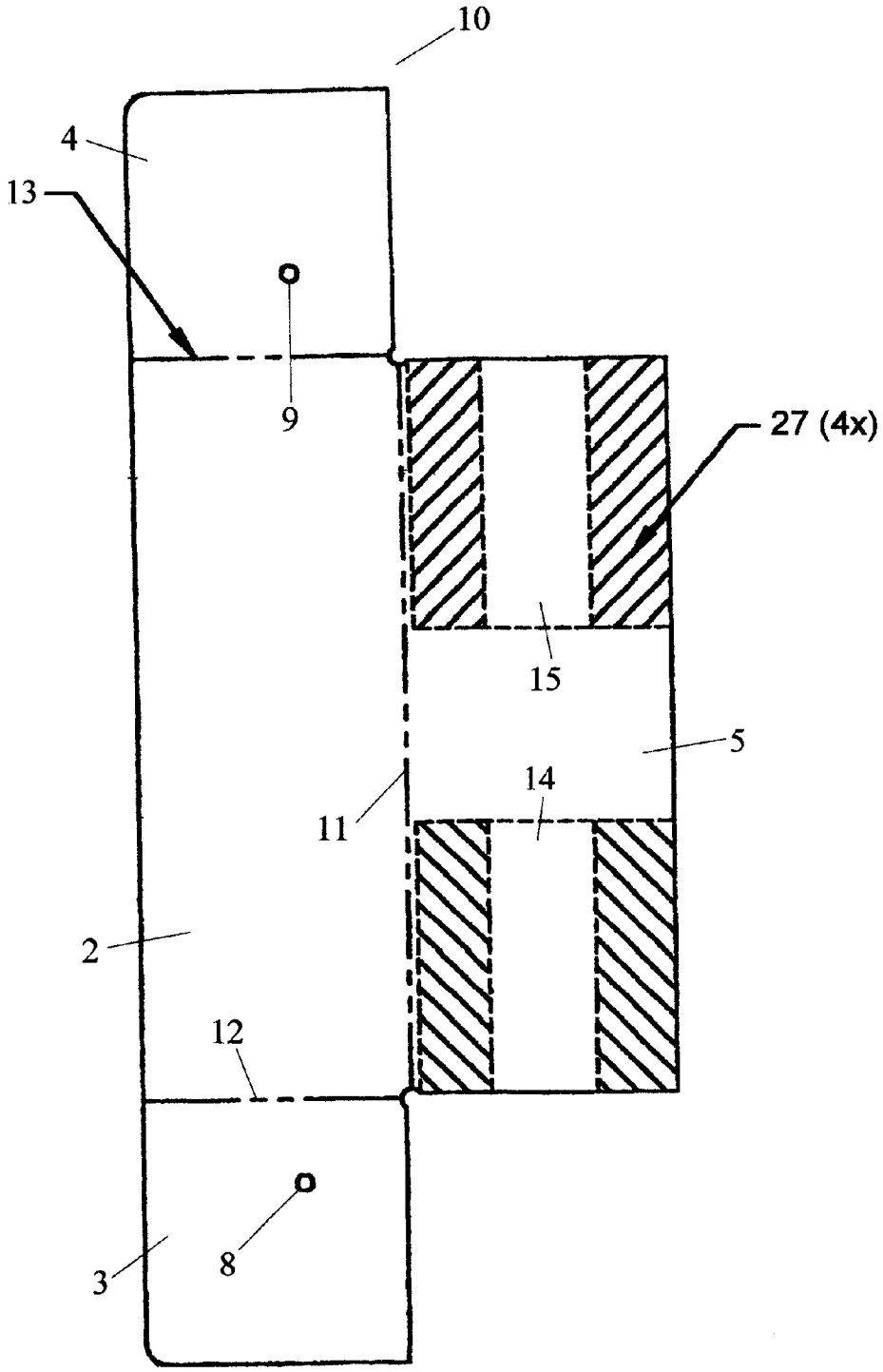
FIG. 2 is a plan view depicting a two-dimensional foldable production blank for producing the embodiment of FIG. 1.

FIG. 2 represents a two-dimensional foldable blank 10 that can be formed into the basic bookcase 1 of FIG. 1. Rear flap 2 is folded upwardly so that rear foldline 11 forms a 90 degree angle. Left side flap 3 and right side flap 4 are then folded inwardly so that left foldline 12 and right foldline 13 form 90 degree angles. Left cardboard doubler 6 and right cardboard doubler 7 (see FIG. 1) are glued to bottom flap 5 at four glue areas 27 along the longitudinal sides of both ends of bottom flap 5, leaving unglued strips 14 and 15 down the middle of each cardboard doubler. The basic bookcase 1 is now configured to receive a set of typical steel bookends. The bottom tang of a standard bookend may slip into the unglued strip at each end of the basic bookcase 1, and the snap buttons 8 and 9 can be attached to the bookends to fix the vertical side flaps 3 and 4.

EXAMPLE 2

Figure 3:
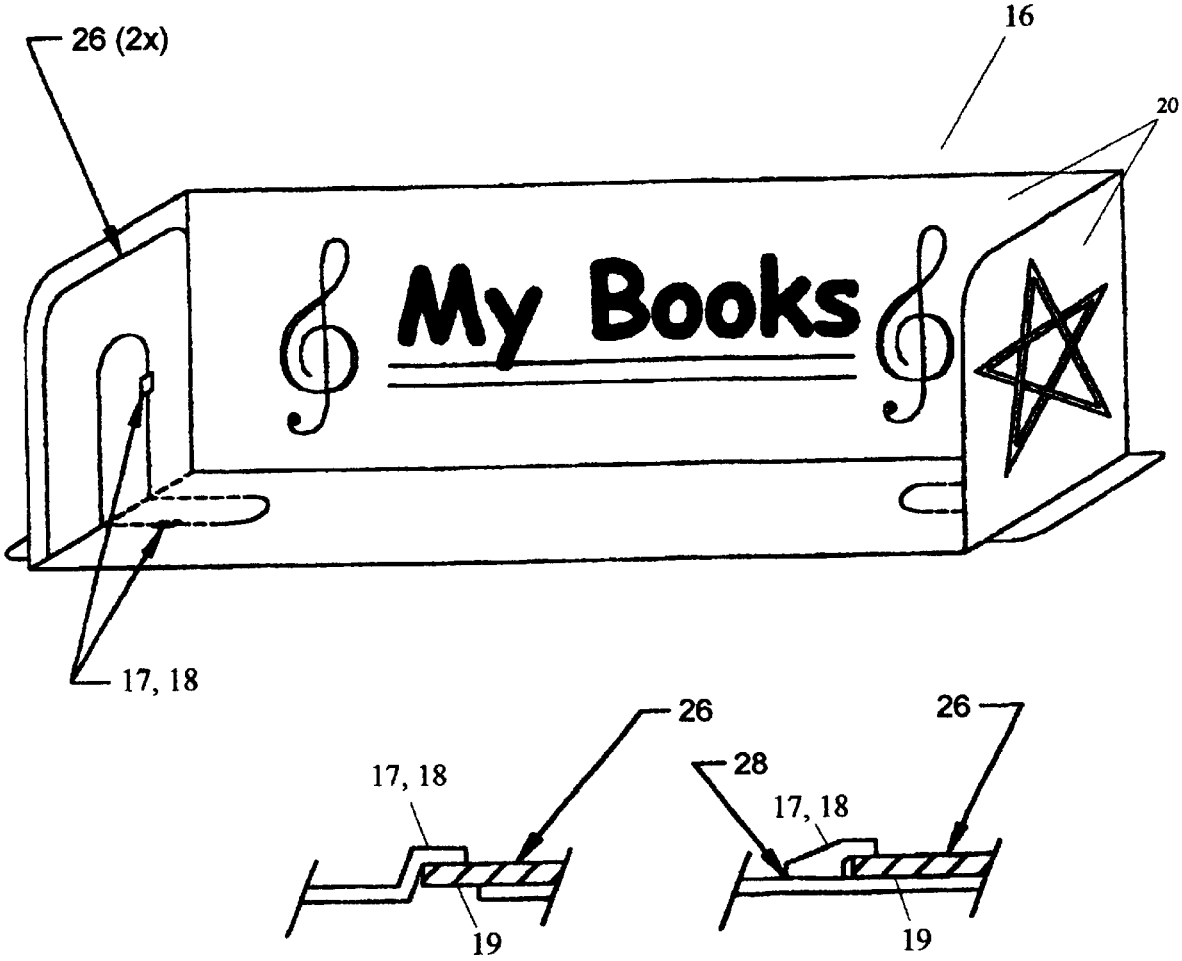
FIG. 3 is a second depiction of one embodiment of the present invention, with assembly tabs, configured for use in combination with pre-existing bookends.

A slight variation on the basic bookcase of FIG. 1 is depicted in FIG. 3, which shows a second basic bookcase 16 utilizing left and right side tabs 17 and left and right bottom tabs 18, in place of the snap buttons and cardboard doublers of FIG. 1. Tab details are illustrated in the cutaway sectional views depicted in FIG. 3. Tabs 17 and 18 may be formed as part of the parent material (e.g. left side flap 3 or bottom flap 5), or may be manufactured from plastic or other suitable material and glued to the parent material using any adhesive 28 suitable for use with cardboard, plastic, or metal, such as construction adhesive, two-part epoxy, or hot glue. In either case, the tab 17 and 18 is configured to overlap bookend material 19, securing the two together and adding structural rigidity to the second basic bookcase 16. FIG. 3 also illustrates possible personalized decorations 20 on the bookcase 16. The bookcase (e.g. 1, 16, or other) should be fabricated from cardboard, plastic, or other suitable inexpensive flexible material, so that decoration or personalization is encouraged.

EXAMPLE 3

Figure 4:
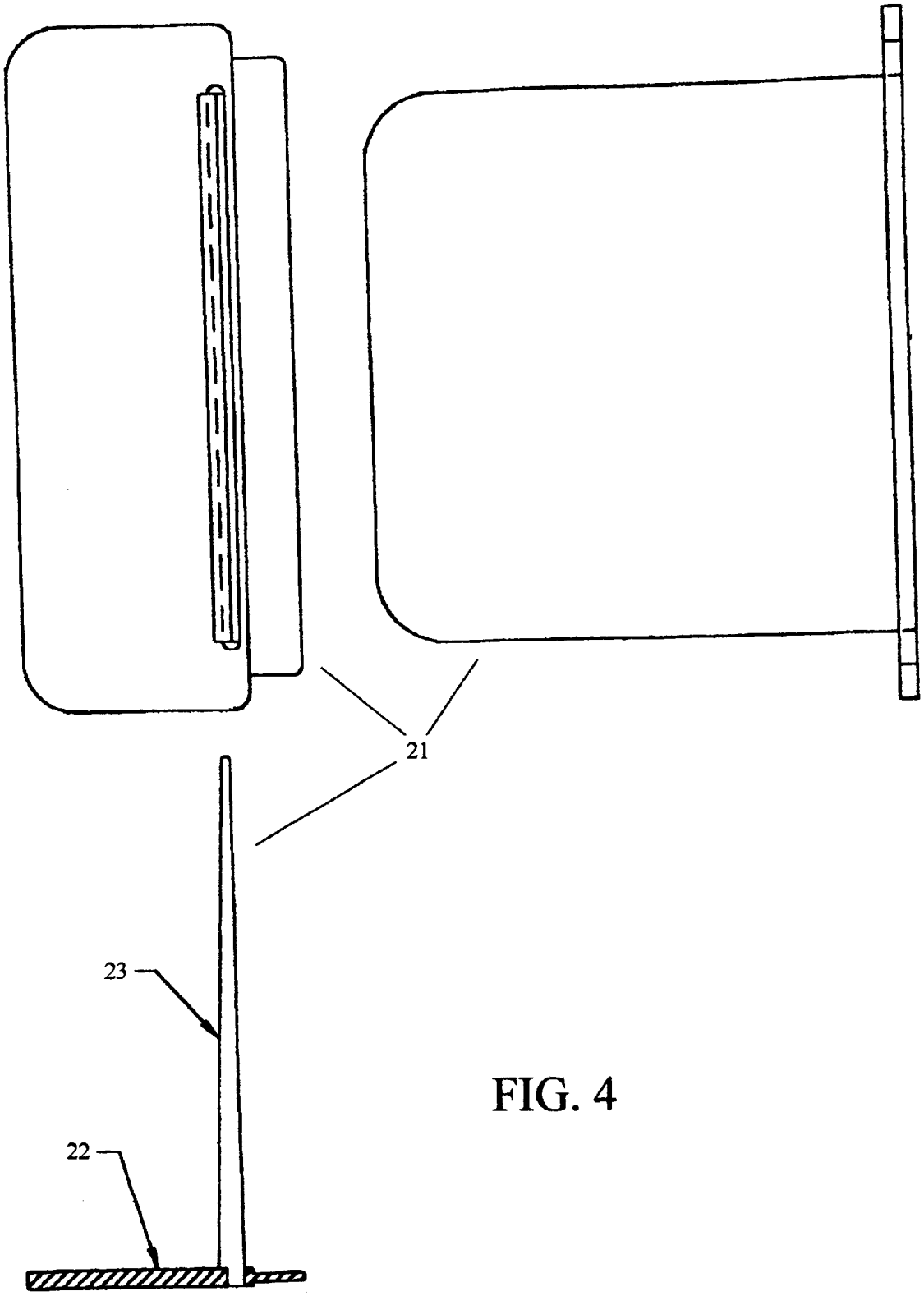
FIG. 4 is an three-view drawing illustrating an assembly of structural reinforcement inserts.

A third example of the subject invention includes molded plastic inserts which take the place of bookends, and could be sold as part of a packaged product resulting from the subject invention. FIG. 4 is a depiction of the molded plastic insert assembly 21, which includes a plastic base 22 and a plastic side 23. The plastic insert components may also be made from wood or other suitably rigid, inexpensive material.

Figure 5:
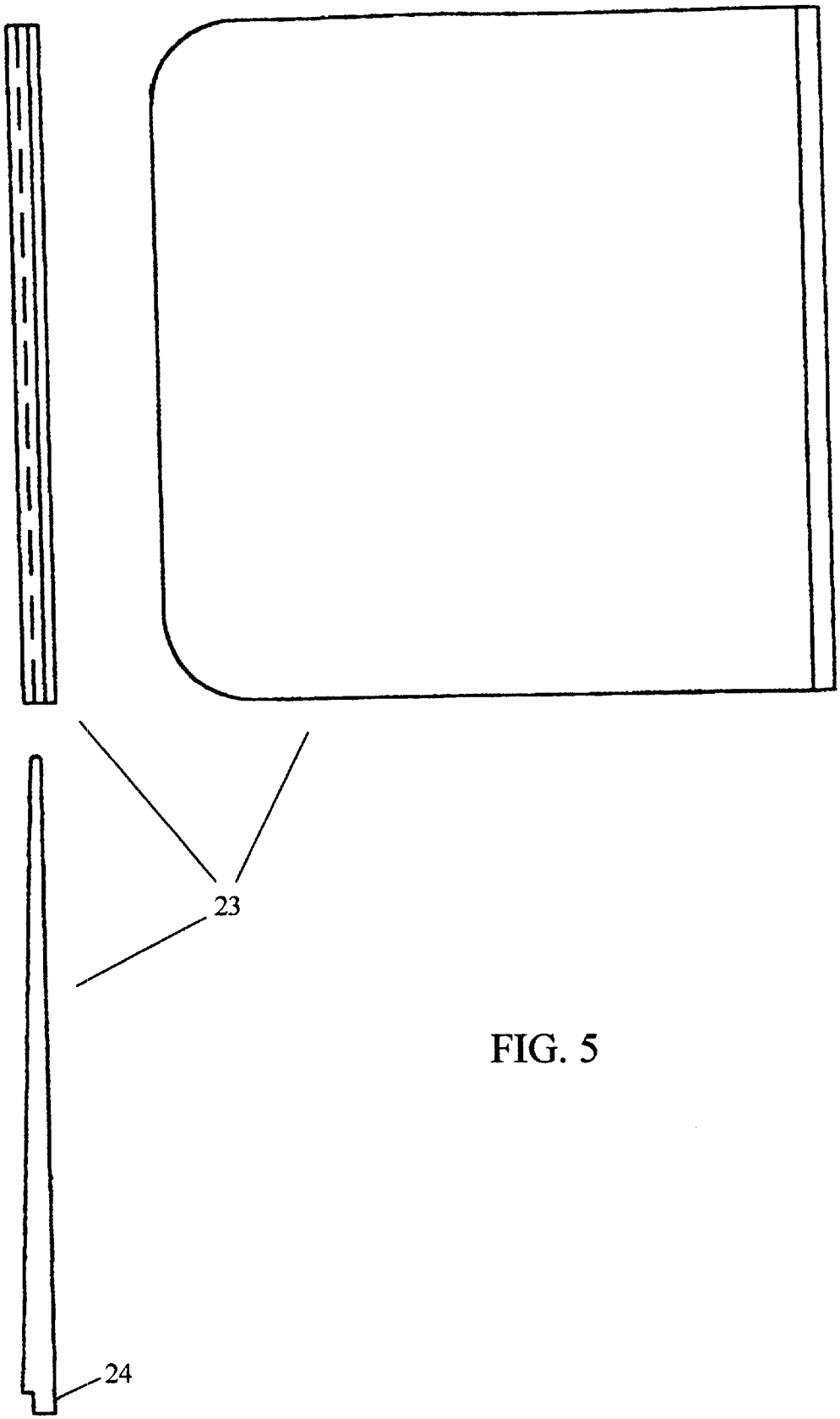
FIG. 5 is a three-view drawing depicting a vertical side component of the structural reinforcement insert assembly illustrated in FIG. 4.
Figure 6:
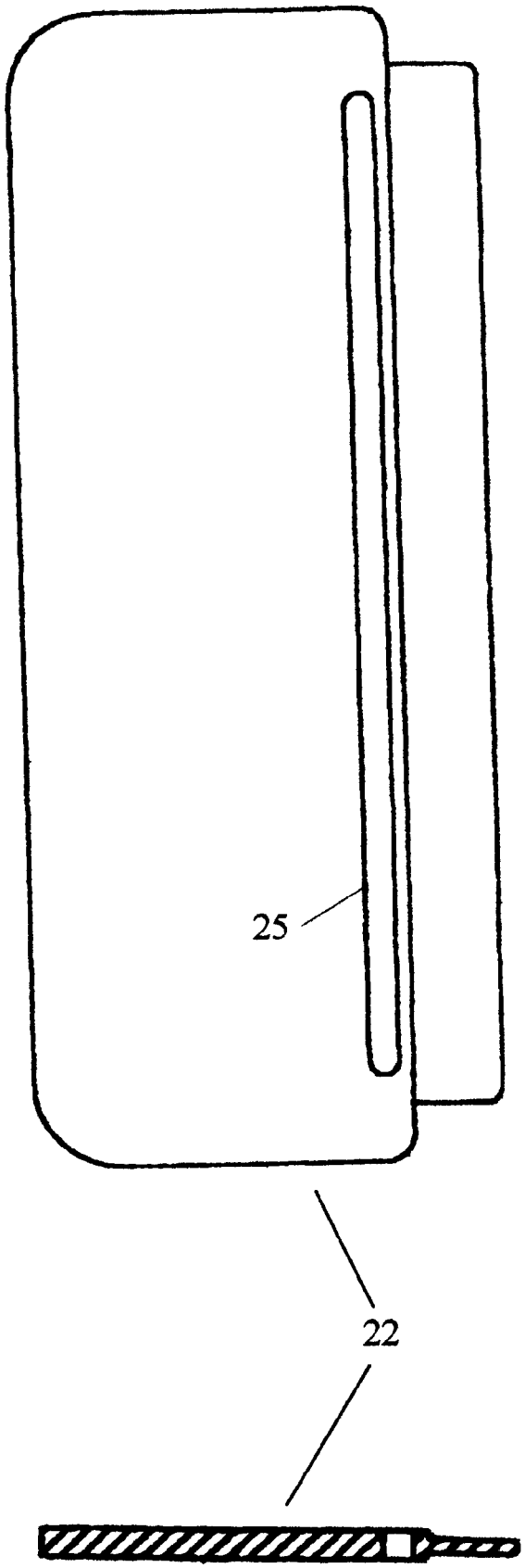
FIG. 6 is a two-view drawing depicting a base component of the reinforcement insert assembly illustrated in FIG. 4.

FIG. 5 depicts an embodiment of the plastic insert side 23, which includes a bottom tang 24. FIG. 6 details the plastic insert base 22, which includes a base slot 25. To assemble the bookcase using the plastic inserts assembly 21 in place of bookends, the foldable blank 10 is again used. Instead of snap buttons 8 and 9 or tabs 17 and 18, however, slots are cut into left side flap 3 and right side flap 4, and into the left and right ends of bottom flap 5. The slots are cut in such a way as to accept the plastic inserts slipped into the flaps, and they are cut so that they are perpendicular to rear flap 2 when the bookcase is assembled. Plastic insert bases 22 are inserted into the two slots in the bottom flap 5, and plastic insert sides 23 are inserted into the two slots in the side flaps 3 and 4. Rear flap 2 is then folded upwardly about 90 degrees, and side flaps 3 and 4 are folded inwardly about 90 degrees, so that the plastic insert assembly 21 can be completed. Bottom tang 24 is inserted into base slot 25 to complete assembly. The result is a product with the same geometric and structural configuration as basic bookcase 1 or 16, but using no pre-existing hardware (e.g. loose bookends).

EXAMPLE 4

Figure 7:
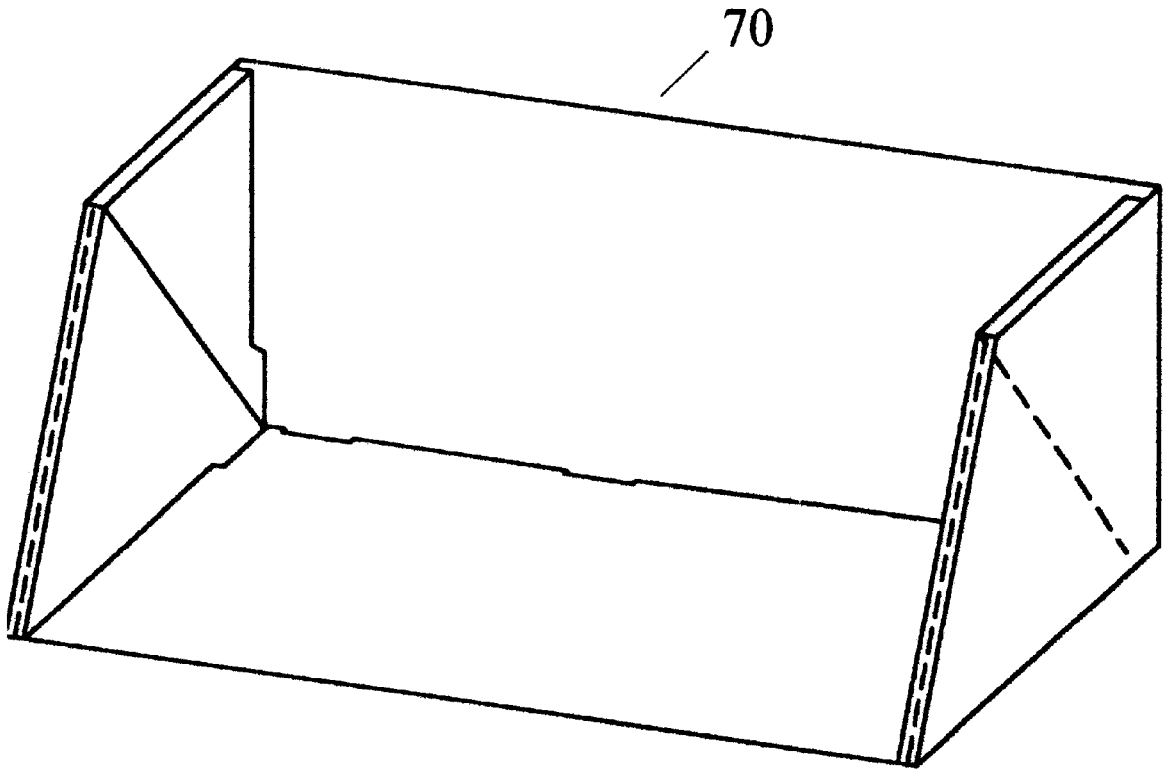
FIG. 7 is a perspective view of an embodiment of the subject invention.

FIG. 7 depicts a clip-free, single level bookcase 70, which requires no extra reinforcement hardware (i.e. no pre-existing bookends and no plastic inserts), although optional reinforcement hardware described later is available for increased strength and/or aesthetic value. FIG. 7 is a three-dimensional view of an assembled embodiment of the subject invention.

Figure 7A:
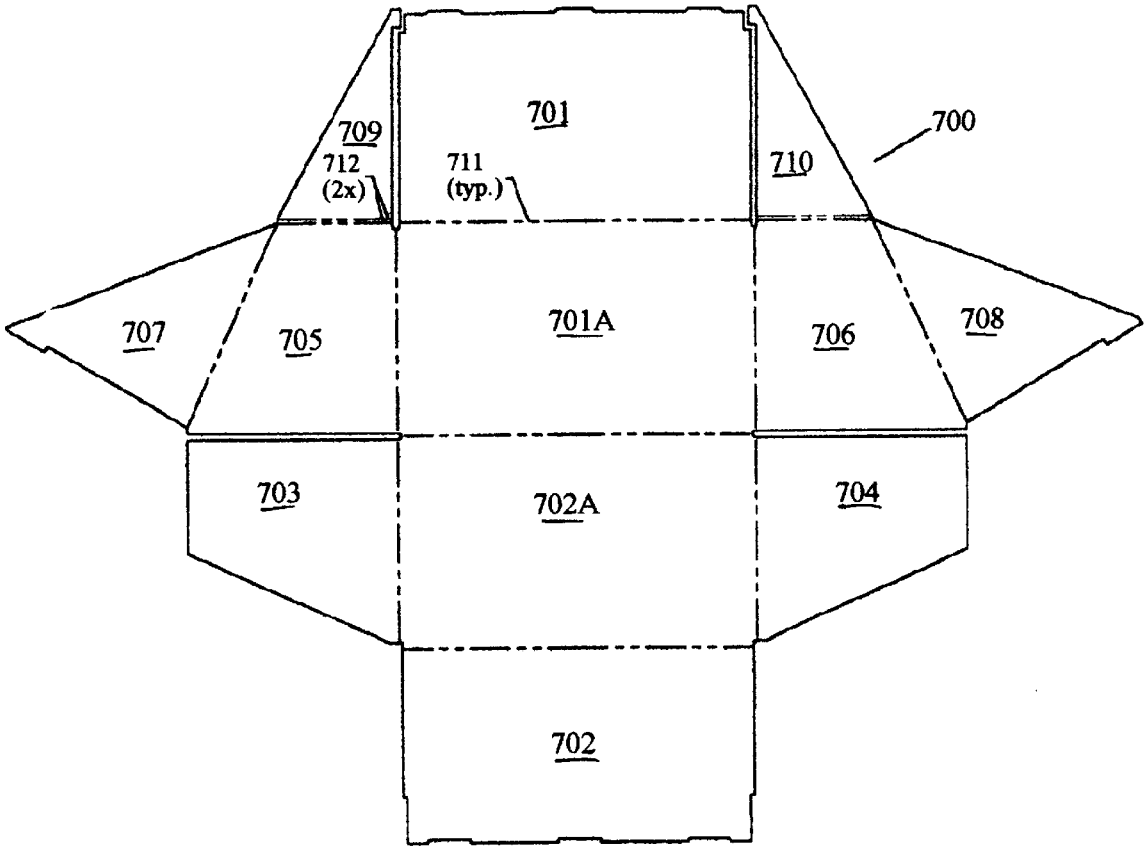
FIG. 7A is a plan view depicting a two-dimensional foldable production blank for producing the embodiment of FIG. 7.

The clip-free, single level bookcase 70 is produced by a folding assembly of the clip-free, single level foldup 700, which is depicted in FIG. 7A. The clip-free, single level foldup 700 is composed of a plurality of flaps and panels, which follow a set of folding instructions to produce the clip-free, single level bookcase 70. The clip-free, single level foldup 700 is also equipped with a number of typical foldlines, one example of which is foldline 711, and two double foldlines 712, which facilitate the folding of flaps over already-folded thicknesses. Additional double foldlines may be optionally utilized in order to improve the ease with which some flaps are folded over other material. The following assembly instructions, taken in conjunction with the associated Figures, will leave no doubt as to how, when, and where each flap should be folded.

Figure 7B:
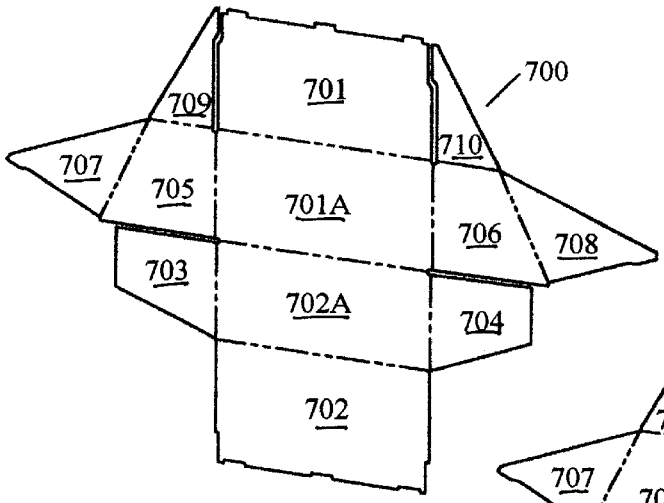
FIG. 7B is a perspective view of the production blank of FIG. 7A, in position for folding to begin.

The clip-free, single level foldup 700 may be fabricated from cardboard, plastic, or other suitable light, inexpensive, and rigid yet flexible material. If one side of the material happens to be finished (e.g. decorated or glossy), the finished side should face downwardly (i.e. into the page), so that the finished surfaces will face outwardly after final assembly of the clip-free, single level bookcase 70. The assembly process for the clip-free, single level bookcase 70 is illustrated in FIG. 7B through FIG. 7G. FIGS. 7B–G are three dimensional depictions of clip-free, single level bookcase 70 at various stages of assembly. FIG. 7B shows a perspective view of the clip-free, single level foldup 700 of FIG. 7A, viewed from the angle at which the subsequent assembly views, FIGS. 7C–G, are viewed.

Figure 7C:
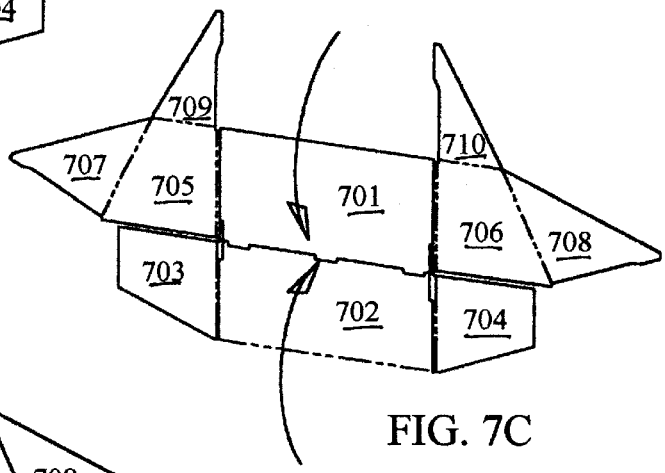
FIG. 7C is an incremental perspective view of the production blank of FIG. 7A, after a first stage of folding.

The first assembly step, as indicated in FIG. 7C, is to fold first flap 701 onto first panel 701A, as shown. Likewise, second flap 702 is folded onto second panel 702A. First and second flaps 701 and 702, respectively, as well as other flaps and panels of the present invention, may be equipped with optional tabs and slots to facilitate interlocking interaction with one another.

Figure 7D:
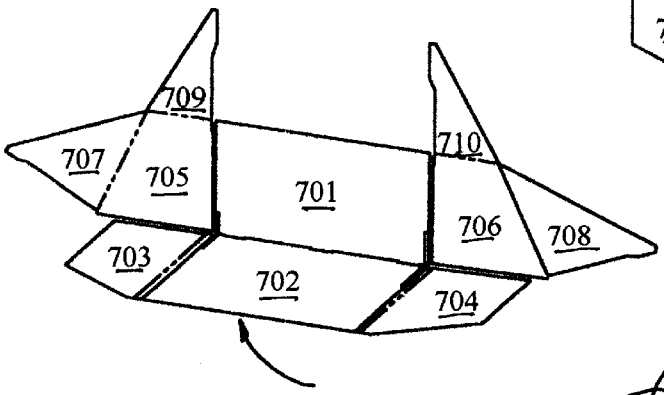
FIG. 7D is a further incremental perspective view of the production blank of FIG. 7A, after a second stage of folding.
Figure 7E:
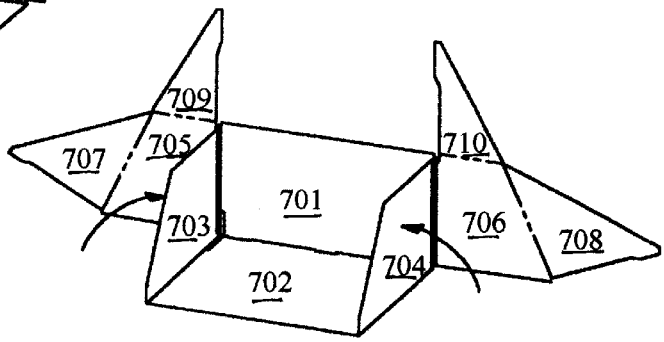
FIG. 7E is an incremental perspective view of the production blank of FIG. 7A after a third stage of folding.
Figure 7F:
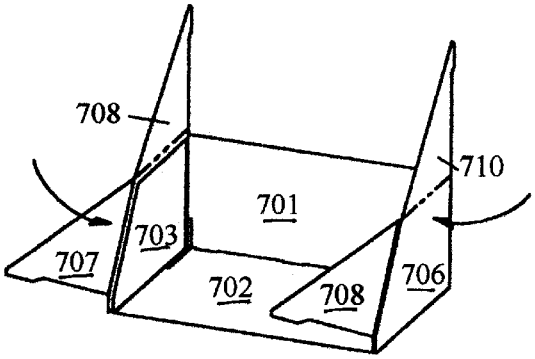
FIG. 7F is an incremental perspective view of the production blank of FIG. 7A after a fourth stage of folding.
Figure 7G:
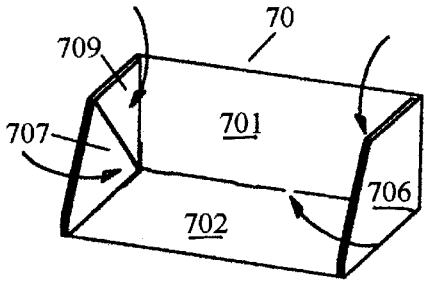
FIG. 7G is an incremental perspective view of the production blank of FIG. 7A after a final stage of folding.

FIG. 7D illustrates the next step, which is to fold the assembly of FIG. 7C, such that first flap 701 is folded upwardly until first flap 701 and second flap 702 are situated with their surfaces about ninety degrees apart. Next, as shown in FIG. 7E, third flap 703 and fourth flap 704 are folded upwardly so that they form angles of about ninety degrees with second flap 702, and about ninety degrees with first flap 701. Next, as indicated in FIG. 7F, fifth flap 705 is folded onto third flap 703, and sixth flap 706 is folded onto fourth flap 704. Finally, as shown in FIG. 7G, seventh flap 707 is folded over third flap 703, and eighth flap 708 is folded over fourth flap 704. Likewise, ninth flap 709 is folded over third flap 703, and tenth flap 710 is folded over fourth flap 704. This completes the folding assembly of the clip-free, single level bookcase 70, although variations and improvements will be readily obvious to one familiar with the art. For example, flaps 707, 708, 709, and 710 might be fixed in place with an adhesive, a tape, or other mechanical fastener of some sort, to discourage disassembly and to improve the structural integrity of the assembly. Such minor discretionary improvements should be considered within the scope of the present invention.

EXAMPLE 5

Figure 8:
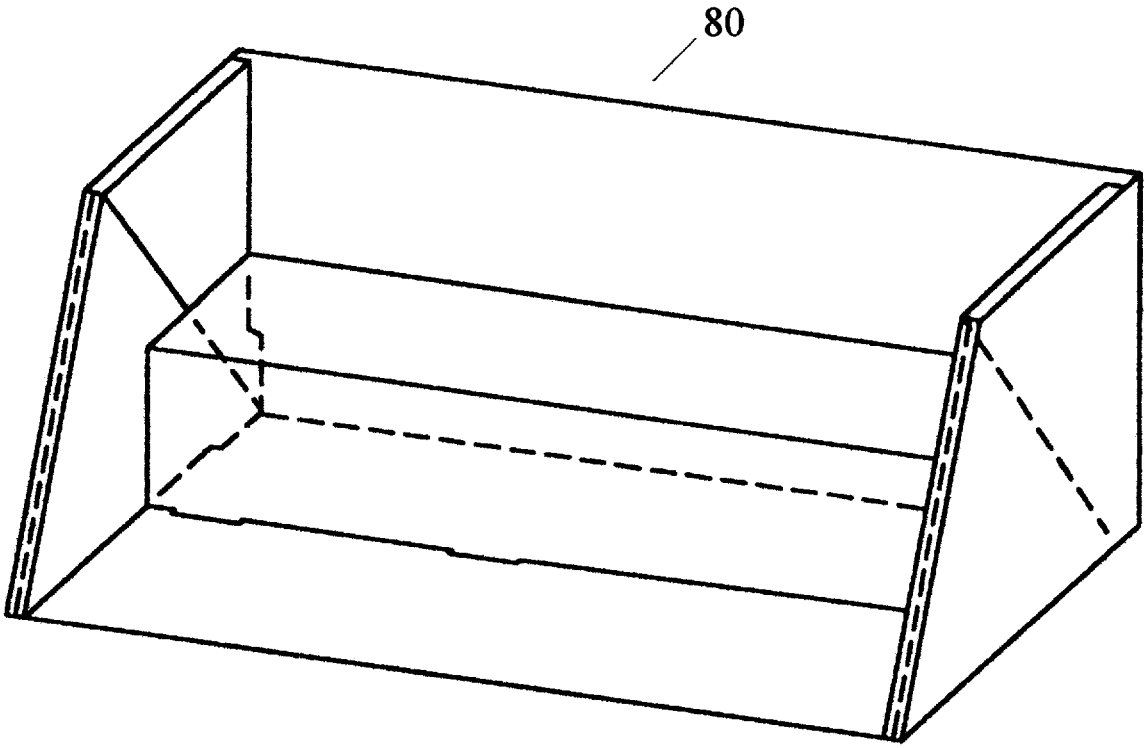
FIG. 8 is a perspective view of an embodiment of the subject invention.

FIG. 8 depicts an alternate embodiment of the subject invention, a clip-free, multi-level bookcase 80, which is a slight variation on the clip-free single level bookcase 70 illustrated in FIG. 7. The clip-free, multi-level bookcase 80 of FIG. 8 adds the feature of a raised ledge within the bookcase structure, which allows books or other items to be stored at a second level, higher and set back from the lower level of stored books. The clip-free, multi-level bookcase 80 provides the user with the ability to store two rows of books in one portable bookcase, especially if the books are smaller than those used with the clip-free single level bookcase 70 of FIG. 7.

Figure 8A:
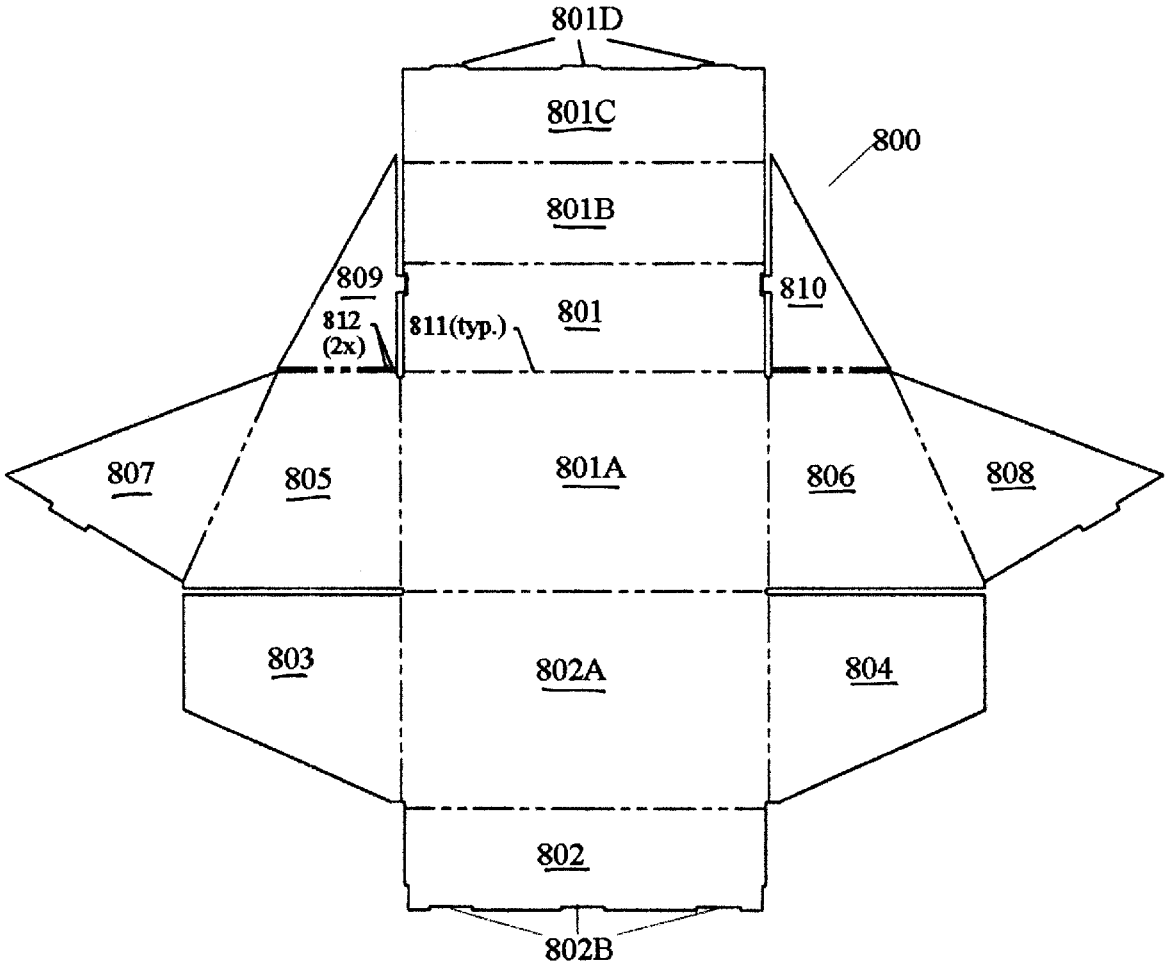
FIG. 8A is a plan view depicting a two-dimensional foldable production blank for producing the embodiment of FIG. 8.

FIG. 8 is a three-dimensional view of an assembled embodiment of the subject invention. The clip-free, multi-level bookcase 80 is produced by a folding assembly of the clip-free, multi-level foldup 800, which is depicted in FIG. 8A. The clip-free, multi-level foldup 800 is composed of a plurality of flaps and panels, which follow a set of folding instructions to produce the clip-free, multi-level bookcase 80. The clip-free, multi-level foldup 800 is also equipped with a number of typical foldlines, one example of which is foldline 811, and two double foldlines 812, which facilitate the folding of flaps over already-folded thicknesses. Additional double foldlines may be optionally utilized in order to improve the ease with which some flaps are folded over other material. The following assembly instructions, taken in conjunction with the associated Figures, clearly described the folding assembly of the clip-free, multi-level bookcase 80. Also, optional tabs (e.g. 801D) may be included on any flaps to facilitate assembly and to improve the structural integrity of the assembled bookcase. Anyone of practical mechanical skill would easily envision the addition of interlocking flaps and associated slots with such an assembly.

Figure 8B:
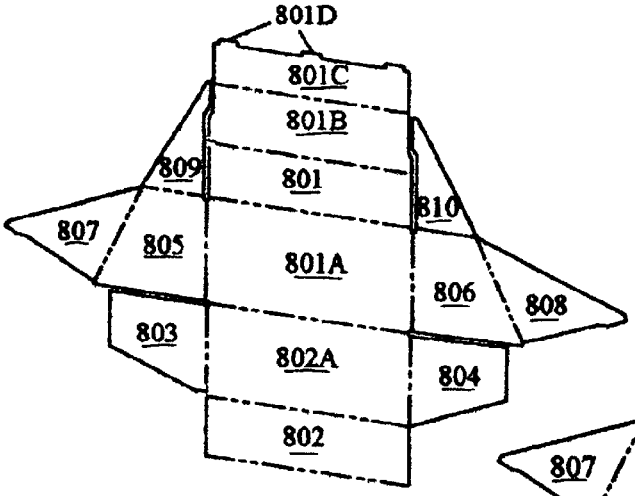
FIG. 8B is a perspective view of the production blank of FIG. 8A, in position for folding to begin.

The clip-free, multi-level foldup 800 may be fabricated from cardboard, plastic, or other suitable light, inexpensive, and rigid yet flexible material. If one side of the material happens to be finished (e.g. decorated or glossy), the finished side should face downwardly (i.e. into the page), so that the finished surfaces will face outwardly after final assembly of the clip-free, multi-level bookcase 80. The assembly process for the clip-free, multi-level bookcase 80 is illustrated in FIG. 8B through FIG. 8G. FIGS. 8B–G are three dimensional depictions of clip-free, multi-level bookcase 80 at various stages of assembly. FIG. 8B shows a perspective view of the clip-free, single level foldup 800 of FIG. 8A, viewed from the angle at which the subsequent assembly views, FIGS. 8C–G, are viewed.

Figure 8C:
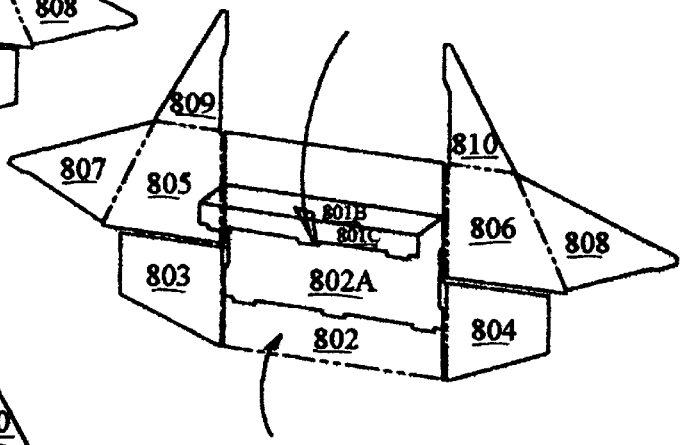
FIG. 8C is an incremental perspective view of the production blank of FIG. 8A, after a first stage of folding.

The result of the first four assembly steps is indicated in FIG. 8C. The first step is to fold first flap 801 downwardly until flat against first panel 801A. Since first flap 801 is lengthened by first extension 801B and second extension 801C, the folded material will encompass more area than first panel 801A. Next, extension 801B is folded upwardly until it is about perpendicular with first flap 801, and with first panel 801A. Next, second extension 801C is folded downwardly until it is about perpendicular with first extension 801B and about parallel with first panel 801A. Finally, second flap 802 is folded as indicated, so that it lies flatly against second panel 802A. The assembly at this point is illustrated in FIG. 8C.

Figure 8D:
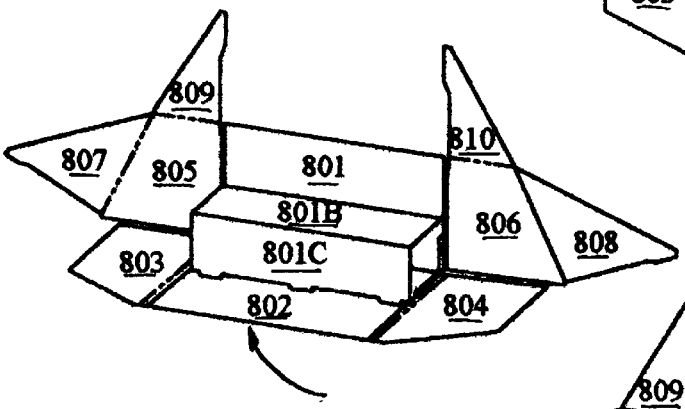
FIG. 8D is a further incremental perspective view of the production blank of FIG. 8A, after a second stage of folding.
Figure 8E:
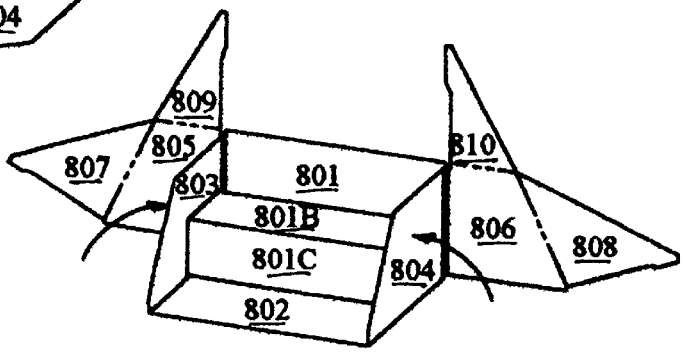
FIG. 8E is an incremental perspective view of the production blank of FIG. 8A after a third stage of folding.
Figure 8F:
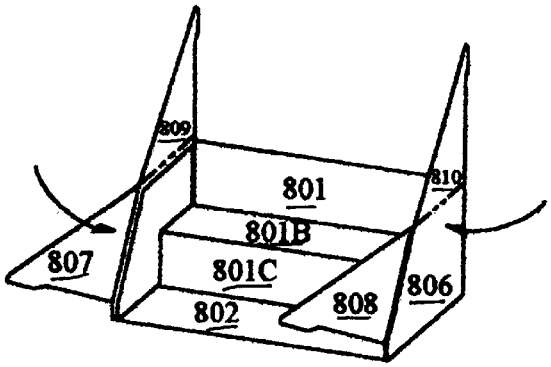
FIG. 8F is an incremental perspective view of the production blank of FIG. 8A after a fourth stage of folding.

Next, first panel 801A is folded upwardly, so that first panel 801A is about perpendicular to second panel 802A, and so that second extension 801C becomes about perpendicular to, and interlocked with, second flap 802. This stage of assembly is illustrated in FIG. 8D. Next, as shown in FIG. 8E, third flap 803 and fourth flap 804 are folded upwardly so that they become about perpendicular both with first panel 801A and with second panel 802A. Next, fifth flap 805 and sixth flap 806 are folded as indicated in FIG. 8F, so that fifth flap 805 is flat against third flap 803, and sixth flap 806 is flat against fourth flap 804.

Figure 8G:
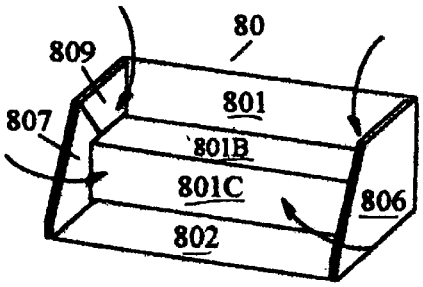
FIG. 8G is an incremental perspective view of the production blank of FIG. 8A after a final stage of folding.

The final steps of the assembly of clip-free, multi-level bookcase 80 are illustrated in FIG. 8G. First, seventh flap 807 and ninth flap 809 are folded as indicated so that they are flat against, and inside of, third flap 803. In folding seventh flap 807 and ninth flap 809, seventh flap 807 is tucked between third flap 803 and the perpendicular second extension 801C, and ninth flap 809 is tucked between third flap 803 and first extension 801B. Likewise, eighth flap 808 and tenth flap 810 are folded as indicated so that they lie flatly against, and inside of, fourth flap 804. In folding eighth flap 808 and tenth flap 810, eighth flap 808 is tucked between fourth flap 804 and the perpendicular second extension 801C, and tenth flap 810 is tucked between fourth flap 804 and first extension 801B. This completes the folding assembly of the clip-free, multi-level bookcase 80, although variations and improvements will be readily obvious to one familiar with the art. For example, flaps 807, 808, 809, and 810 might be fixed in place with an adhesive, a tape, or other mechanical fastener of some sort, to discourage disassembly and to improve the structural integrity of the assembly. Such minor discretionary improvements should be considered within the scope of the present invention.

EXAMPLE 6

Figure 9:
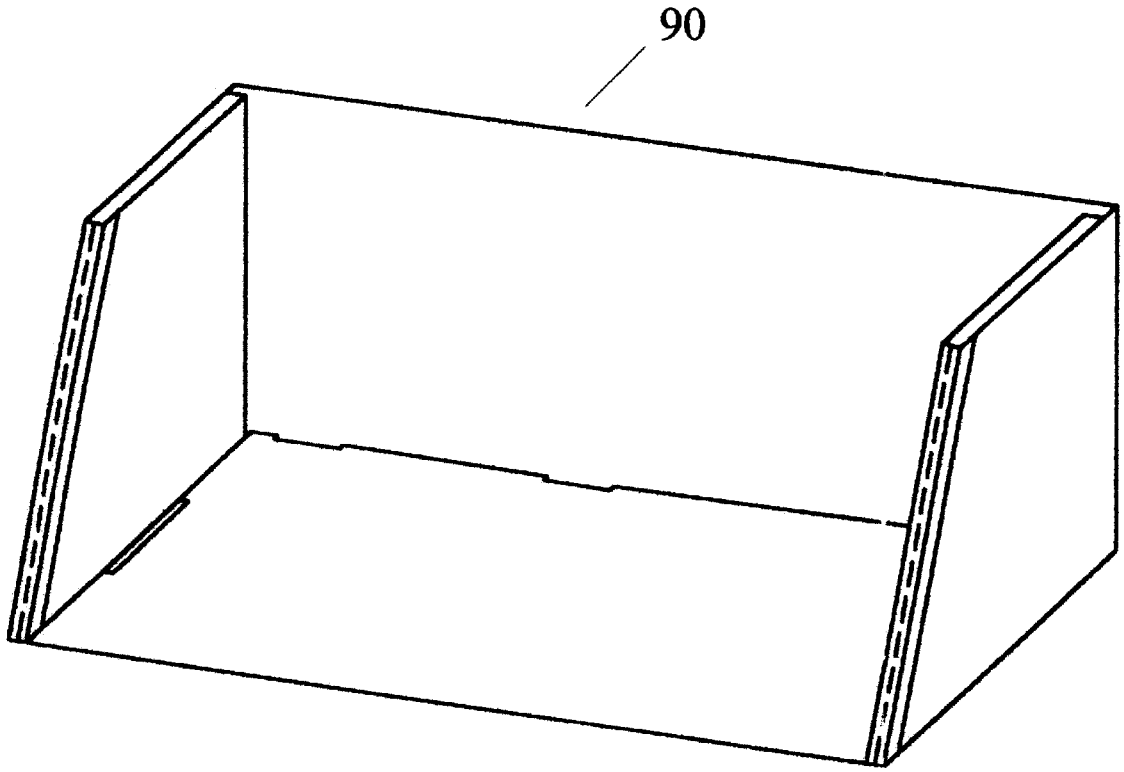
FIG. 9 is a perspective view of an embodiment of the subject invention.

FIG. 9 depicts a clip-reinforced, single level bookcase 90. The clip-reinforced, single level bookcase 90 requires no extra reinforcement hardware (i.e. no pre-existing bookends and no plastic inserts), but optional reinforcement hardware described later is available for increased strength and/or aesthetic value. In addition, a set of U-shaped channel clips, described later, is recommended for improving the strength and aesthetic value of the clip-reinforced, single level bookcase 90.

Figure 9A:
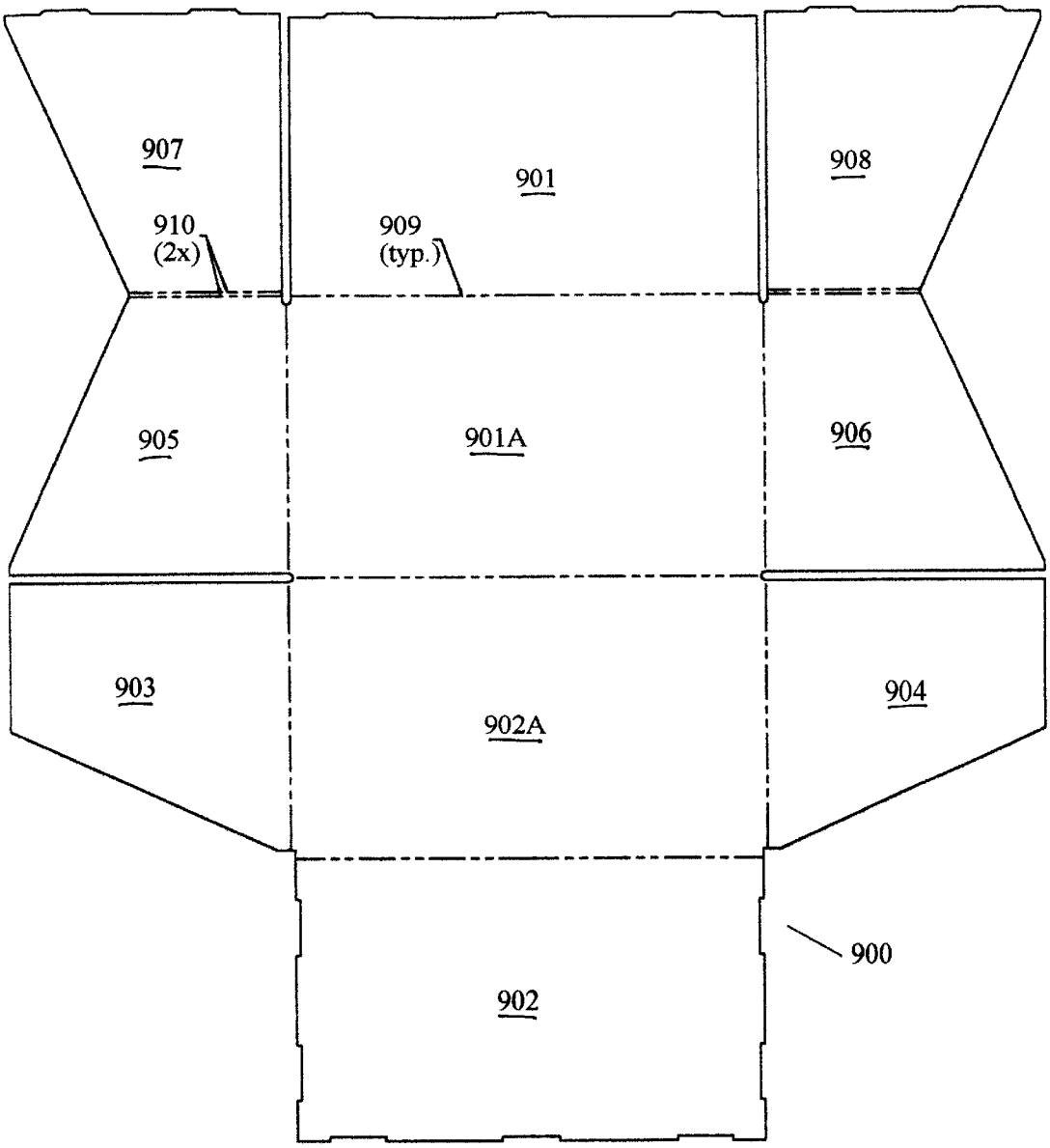
FIG. 9A is a plan view depicting a two-dimensional foldable production blank for producing the embodiment of FIG. 9.

FIG. 9 is a three-dimensional view of an assembled embodiment of the subject invention. The clip-reinforced, single level bookcase 90 is produced by a folding assembly of the clip-reinforced, single level foldup 900, which is depicted in FIG. 9A. The clip-reinforced, single level foldup 900 is composed of a plurality of flaps and panels, which follow a set of folding instructions to produce the clip-reinforced, single level bookcase 90. The clip-reinforced, single level foldup 900 is also equipped with a number of typical foldlines, one example of which is foldline 909, and two double foldlines 910, which facilitate the folding of flaps over already-folded thicknesses. Additional double foldlines may be optionally utilized in order to improve the ease with which some flaps are folded over other material. The following assembly instructions, taken in conjunction with the associated Figures, will clearly describe the folding assembly process for the clip-reinforced, single level bookcase 90.

Figure 9B:
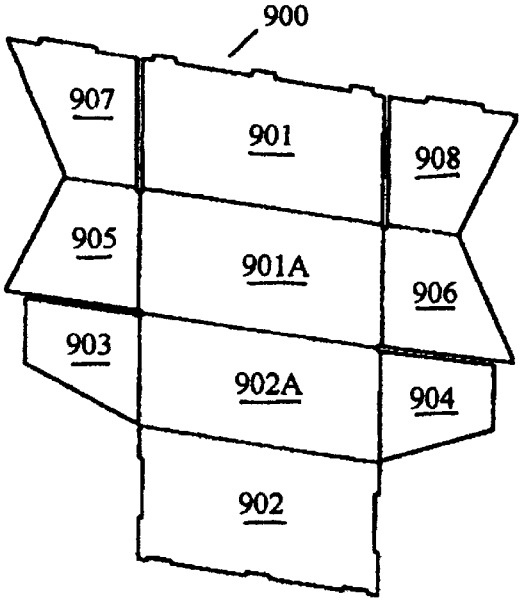
FIG. 9B is a perspective view of the production blank of FIG. 9A, in position for folding to begin.

The clip-reinforced, single level foldup 900 may be fabricated from cardboard, plastic, or other suitable light, inexpensive, and rigid yet flexible material. If one side of the material happens to be finished (e.g. decorated or glossy), the finished side should face downwardly (i.e. into the page), so that the finished surfaces will face outwardly after final assembly of the clip-reinforced, single level bookcase 90. The assembly process for the clip-reinforced, single.level bookcase 90 is illustrated in FIG. 9B through FIG. 9G. FIGS. 9B–G are three dimensional depictions of clip-reinforced, single level bookcase 90 at various stages of assembly. FIG. 9B shows a perspective view of the clip-reinforced, single level foldup 900 of FIG. 9A, viewed from the angle at which the subsequent assembly views, FIGS. 9C–G, are viewed.

Figure 9C:
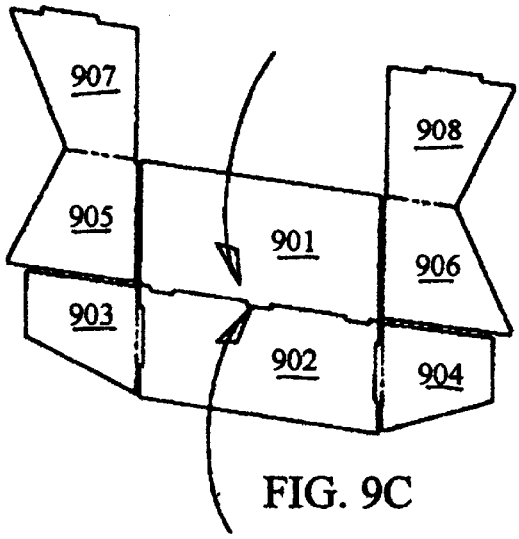
FIG. 9C is an incremental perspective view of the production blank of FIG. 9A, after a first stage of folding.

The first assembly step, as indicated in FIG. 9C, is to fold first flap 901 onto first panel 901A, as shown. Likewise, second flap 7902 is folded onto second panel 902A. First and second flaps 901 and 902, respectively, as well as other flaps and panels of the present invention, may be equipped with optional tabs and slots to facilitate interlocking interaction with one another.

Figure 9D:
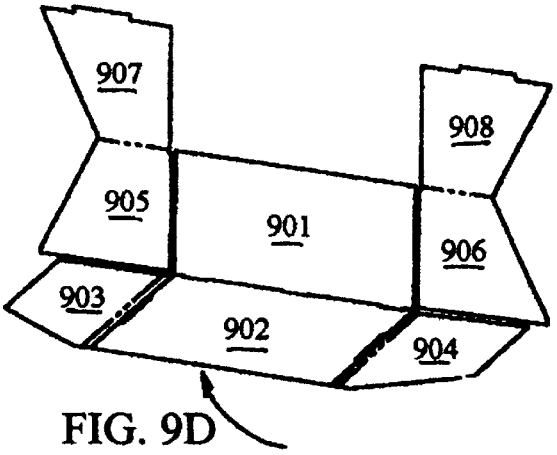
FIG. 9D is a further incremental perspective view of the production blank of FIG. 9A, after a second stage of folding.
Figure 9E:
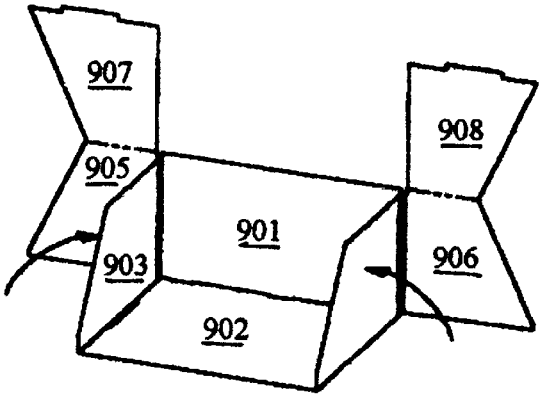
FIG. 9E is an incremental perspective view of the production blank of FIG. 9A after a third stage of folding.
Figure 9F:
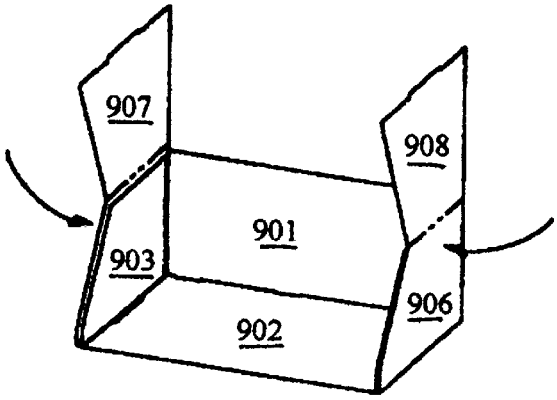
FIG. 9F is an incremental perspective view of the production blank of FIG. 9A after a fourth stage of folding.

FIG. 9D illustrates the next step, which is to fold the assembly of FIG. 9C, such that first flap 901 is folded upwardly until first flap 901 and second flap 902 are situated with their surfaces about ninety degrees apart. Next, as shown in FIG. 9E, third flap 903 and fourth flap 904 are folded upwardly so that they form angles of about ninety degrees with second flap 902, and about ninety degrees with first flap 901. Next, as indicated in FIG. 9F, fifth flap 905 is folded onto third flap 903, and sixth flap 906 is folded onto fourth flap 904.

Figure 9G:
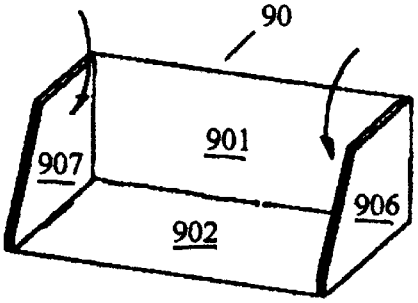
FIG. 9G is an incremental perspective view of the production blank of FIG. 9A after a final stage of folding.

Finally, as shown in FIG. 9G, seventh flap 907 is folded over third flap 903, and eighth flap 908 is folded over fourth flap 904. This completes the folding assembly of the clip-free, single level bookcase 70, although variations and improvements will be readily obvious to one familiar with the art. For example, flaps 907 and 908 might be fixed in place with an adhesive, a tape, or other mechanical fastener of some sort, to discourage disassembly and to improve the structural integrity of the assembly. Such minor discretionary improvements should be considered within the scope of the present invention: Additionally, U-shaped channel clip hardware, described later, is recommended structural and aesthetic improvement, due to the open nature of the edges of the clip-reinforced, single level bookcase 90 resulting from this described method of assembly.

EXAMPLE 7

Figure 10:
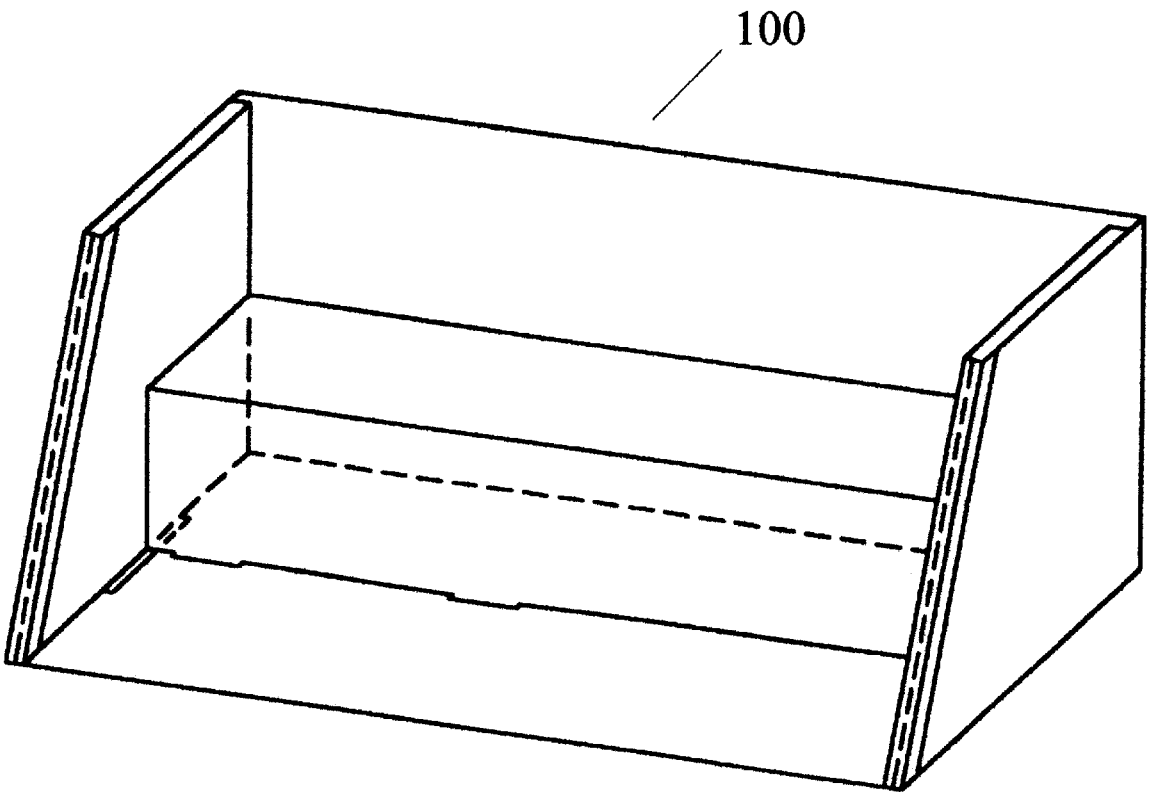
FIG. 10 is a perspective view of an embodiment of the subject invention.

FIG. 10 depicts another embodiment of the subject invention, a clip-reinforced, multi-level bookcase 100, which is a slight variation on the clip-reinforced single level bookcase 90 illustrated in FIG. 9. The clip-reinforced, multi-level bookcase 100 of FIG. 10 adds the feature of a raised ledge within the bookcase structure, providing means for books or other items to be stored at a second, higher level, and set back from the lower level of stored books. The clip-reinforced, multi-level bookcase 100 provides the user with the ability to store two rows of books in one portable bookcase, especially if the books are smaller than those used with the clip-reinforced single level bookcase 90 of FIG. 9.

Figure 10A:
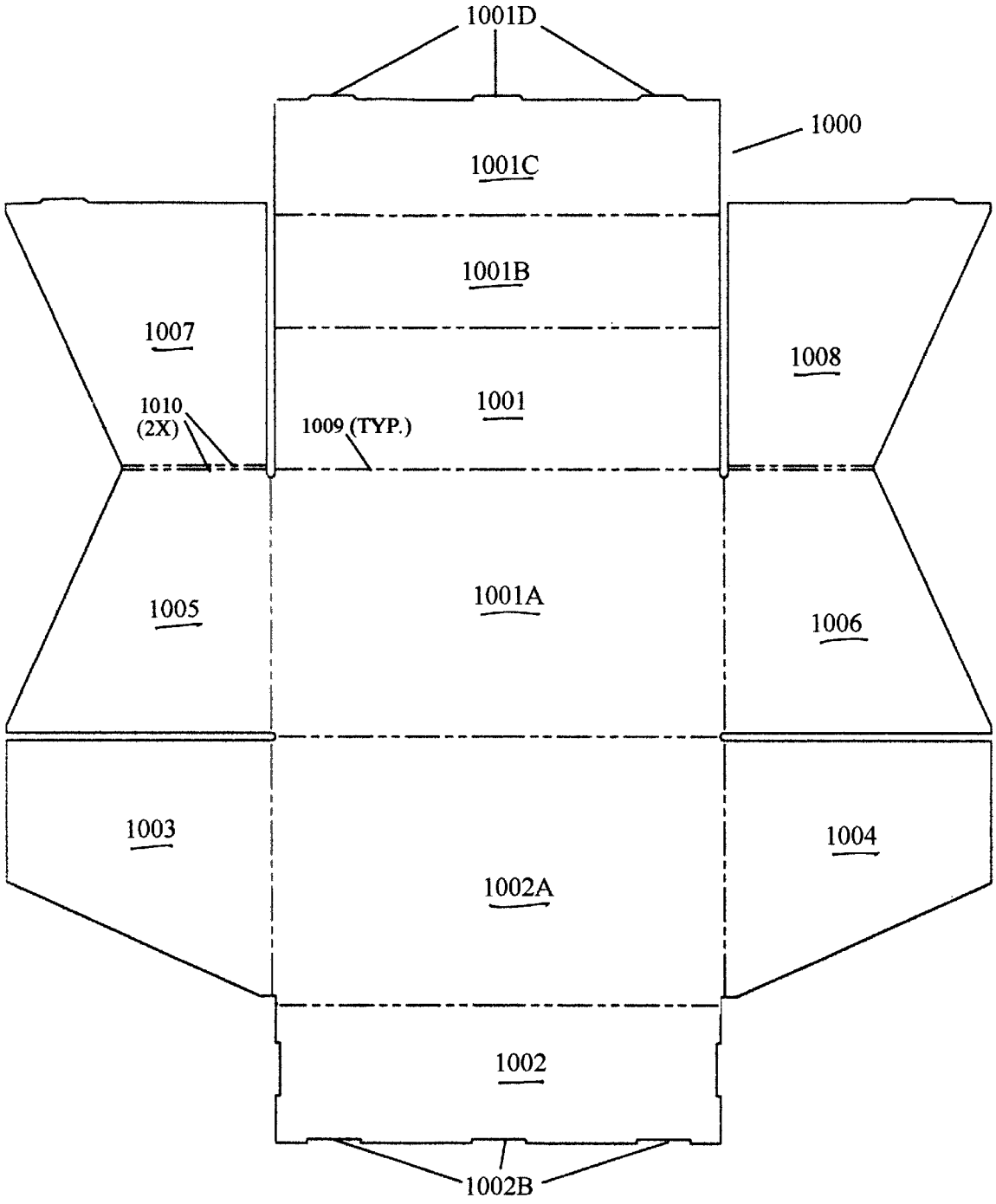
FIG. 10A is a plan view depicting a two-dimensional foldable production blank for producing the embodiment of FIG. 10.

FIG. 10 is a three-dimensional view of an assembled embodiment of the subject invention. The clip-reinforced, multi-level bookcase 100 is produced by a folding assembly of the clip-reinforced, multi-level foldup 1000, which is depicted in FIG. 10A. The clip-reinforced, multi-level bookcase 100 is composed of a plurality of flaps and panels, which follow a set of folding instructions to produce the clip-reinforced, multi-level bookcase 100. The clip-reinforced, multi-level foldup 1000 is also equipped with a number of typical foldlines, one example of which is foldline 1009, and two double foldlines 1010, which facilitate the folding of flaps over already-folded thicknesses. Additional double foldlines may be optionally utilized in order to improve the ease with which some flaps are folded over other material.

The following assembly instructions, taken in conjunction with the associated Figures, describe the folding assembly of the clip-reinforced, multi-level bookcase 100. Also, optional tabs (e.g. 1001D) and optional slots (e.g. 1002B) may be included on any flaps to facilitate assembly, and to improve the structural integrity of the assembled bookcase. Anyone practiced in the mechanical arts could envision the addition of interlocking flaps and associated slots with such an assembly.

Figure 10B:
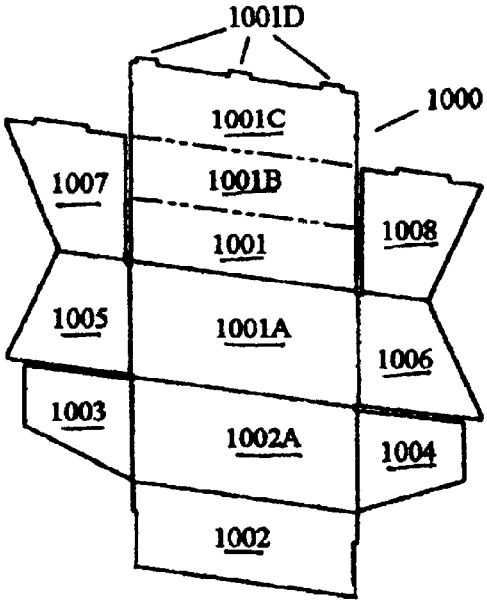
FIG. 10B is a perspective view of the production blank of FIG. 10A, in position for folding to begin.

The clip-reinforced, multi-level bookcase 100 may be fabricated from cardboard, plastic, or other suitable light, inexpensive, and rigid yet flexible material. If one side of the material happens to be finished (e.g. decorated or glossy), the finished side should face downwardly (i.e. into the page), so that the finished surfaces will face outwardly after final assembly of the clip-reinforced, multi-level bookcase 100. The assembly process for the clip-reinforced, multi-level bookcase 100 is illustrated in FIG. 10B through FIG. 10G. FIGS. 10B–G are three dimensional depictions of clip-reinforced, multi-level bookcase 100 at various stages of assembly. FIG. 10B shows a perspective view of the clip-reinforced, single level foldup 1000 of FIG. 10A, viewed from the angle at which the subsequent assembly views, FIGS. 10C–G, are viewed.

Figure 10C:
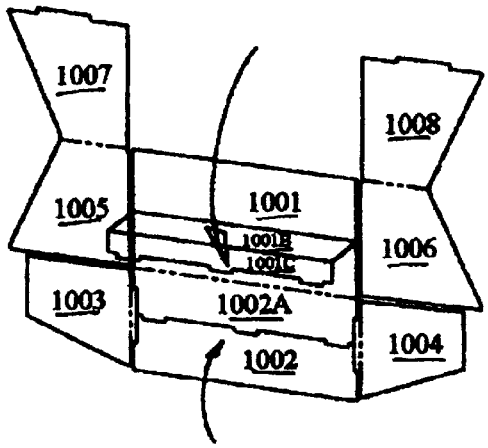
FIG. 10C is an incremental perspective view of the production blank of FIG. 10A, after a first stage of folding.

The result of the first four assembly steps is indicated in FIG. 10C. The first step is to fold first flap 1001 downwardly until flat against first panel 1001A. Since first flap 1001 is lengthened by first extension 1001B and second extension 1001C, the folded material will encompass more area than first panel 1001A. Next, extension 1001B is folded upwardly until-it is about perpendicular with first flap 1001, and with first panel 1001A. Next, second extension 1001C is folded downwardly until it is about perpendicular with first extension 1001B, and about parallel with first panel 1001A. Finally, second flap 1002 is folded as indicated, so that it lies flatly against second panel 1002A. The assembly at this point is illustrated in FIG. 10C.

Figure 10D:
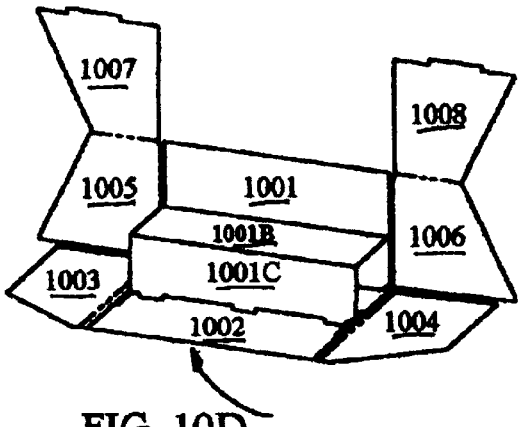
FIG. 10D is a further incremental perspective view of the production blank of FIG. 10A, after a second stage of folding.
Figure 10E:
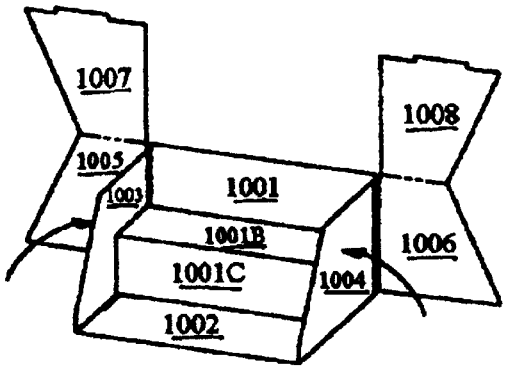
FIG. 10E is an incremental perspective view of the production blank of FIG. 10A after a third stage of folding.
Figure 10F:
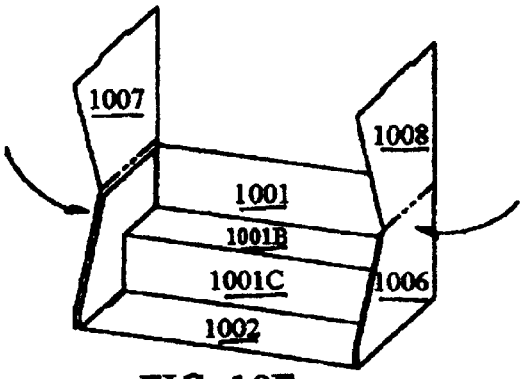
FIG. 10F is an incremental perspective view of the production blank of FIG. 10A after a fourth stage of folding.

Next, first panel 1001 A is folded upwardly, so that first panel 1001A is about perpendicular to second panel 1002A, and so that second extension 1001C becomes about perpendicular to, and interlocked with, second flap 1002. This stage of assembly is illustrated in FIG. 10D. Next, as shown in FIG. 10E, third flap 1003 and fourth flap 1004 are folded upwardly so that they become about perpendicular both with first panel 1001A and with second panel 1002A. Next, fifth flap 1005 and sixth flap 1006 are folded as indicated in FIG. 10F, so that fifth flap 1005 is flat against third flap 1003, and sixth flap 1006 is flat against fourth flap 1004.

Figure 10G:
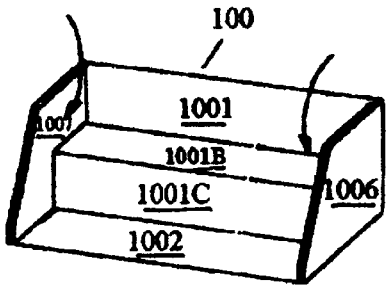
FIG. 10G is an incremental perspective view of the production blank of FIG. 10A after a final stage of folding.

The final steps of the assembly of clip-reinforced, multi-level bookcase 100 are illustrated in FIG. 10G. Seventh flap 1007 is folded as indicated so that it is flat against, and inside of, third flap 1003. In folding seventh flap 1007, seventh flap 1007 is tucked between third flap 1003 and the perpendicular first extension 1001B. Likewise, eighth flap 1008 is folded as indicated so that it lies flatly against, and inside of, fourth flap 1004. In folding eighth flap 1008, eighth flap 1008 is tucked between fourth flap 1004 and the perpendicular first extension 1001B.

This completes the folding assembly of the clip-reinforced, multi-level bookcase 100, although variations and improvements will be readily obvious to one familiar with the art. For example, flaps 1007 and 1008 might be fixed in place with an adhesive, a tape, or other mechanical fastener of some sort, to discourage disassembly and to improve the structural integrity of the assembly. Such minor discretionary improvements should be considered within the scope of the present invention. Additionally, U-shaped channel clip hardware, described later, is recommended for providing structural and aesthetic improvement, due to the open nature of the edges of the clip-reinforced, multi-level bookcase 100 resulting from this described method of assembly.

Reinforcement Hardware

Figure 11A:
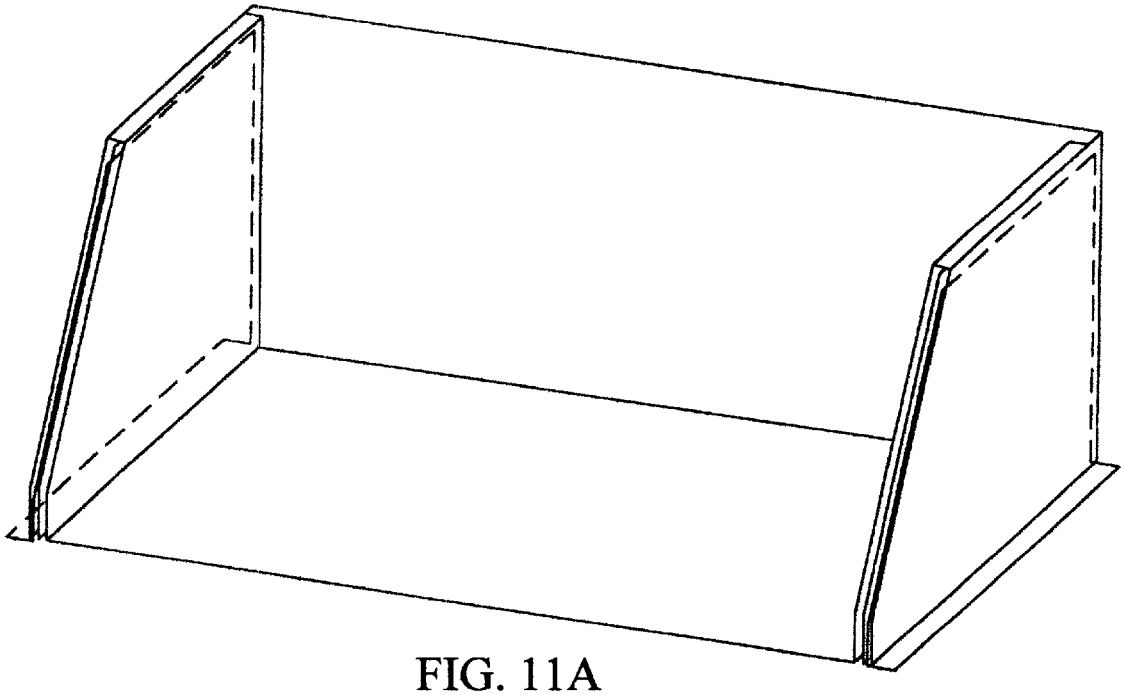
FIG. 11A is a perspective view of an assembly of an embodiment of the subject invention with a set of two reinforcement end pieces.
Figure 11:
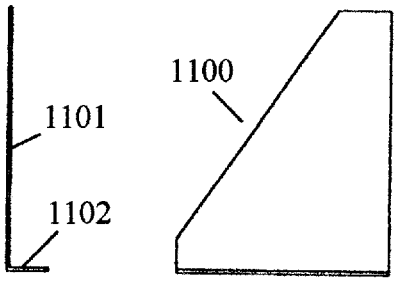
FIG. 11 is a two-view drawing of an embodiment of a reinforcement end piece.

Referring now to FIG. 11, one embodiment of a right hand end piece 1100 is illustrated. The right hand end piece 1100 is a uni-body piece of hardware, made of plastic, metal, or other suitable stiff, inexpensive material. The right hand end piece 1100 comprises a vertical tongue 1101 and a base 1102. The vertical tongue 1101 and the base 1102 are about perpendicular to one another, and the material and method of manufacture chosen should be such as to maintain this orientation rigidly throughout usage.

The vertical tongue 1101 slips between flaps at one end of embodiments of the clip-free single level bookcase 70, the clip-free multi-level bookcase 80, the clip-reinforced single level bookcase 90, or the clip-reinforced multi-level bookcase 100. The geometry of the vertical tongue 1101 is similar to the geometries of the flaps into which it slips, but can be made slightly smaller to facilitate easier installation. For example, the vertical tongue for an embodiment of a right hand end piece 1100 to be used in conjunction with the clip-reinforced multi-level bookcase 100 would have a geometry similar to that of fourth flap 1004, sixth flap 1006, and eighth flap 1008. Decreasing the dimensions of the vertical tongue 1101 slightly, e.g. by ¼-inch vertically and ¼-inch horizontally, will make insertion into the flaps easier.

The purpose of the right hand end piece 1100 is to help stiffen the ends of the assembled embodiment of the clip-free single level bookcase 70, the clip-free multi-level bookcase 80, the clip-reinforced single level bookcase 90, or the clip-reinforced multi-level bookcase 100. The vertical tongue 1101 adds stiffness to the end of the bookcase, and the base 1102 supports the vertical tongue 1101 by laying flatly against the surface upon which the bookcase rests (e.g. a desktop).

Not shown in FIG. 11, but easily envisioned by one skilled in a mechanical art, is an end piece which would provide similar benefit to the bookcase, but at the end opposite the end reinforced by the right hand end piece 1100. Such an opposite (left) end piece would be the physical embodiment of a mirror image of the right hand end piece 1100. One skilled in mechanical arts, such as machining or manufacturing, would easily envision, and could easily fabricate, such an opposite end piece. FIG. 11A demonstrates how an embodiment of the present invention, e.g. the clip-reinforced multi-level bookcase 100, might look as it is assembled with end piece reinforcement.

Figure 12:
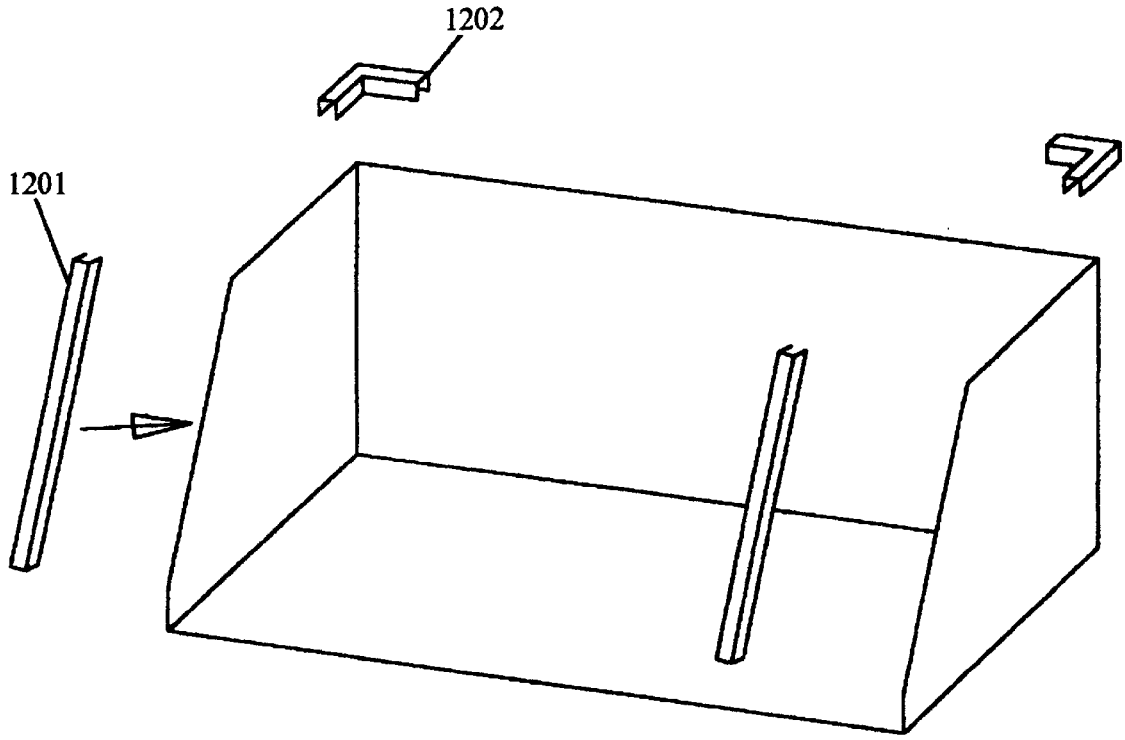
FIG. 12 is a perspective view illustrating the geometry for embodiments of diagonal reinforcement clips and corner reinforcement clips, demonstrating their approximate assembly positions on an embodiment of the present invention.

Referring now to FIG. 12, diagonal clips 1201 and corner clips 1202 are illustrated. The diagonal clips 1201 and corner clips 1202 can be manufactured from an inexpensive, lightweight, and suitably stiff material such as plastic or metal, similar to the material used to make the right hand end piece 1100. The diagonal clips 1201 and corner clips 1202 have similar U-shaped cross-sectional geometries, shaped and sized so as to enclose the edges of the assembled subject invention, as indicated in FIG. 12. For example, if used in conjunction with the clip-reinforced, multi-level bookcase 100 of FIG. 10, the diagonal clips 1201 and corner clips 1202 should be sized such that the U-shaped cross section encloses the edges created by the multi-layer end wall of fourth flap 1004, sixth flap 1006, and eighth flap 1008. A number of variations of length, material, and cross-sectional geometry for the diagonal clips 1201 and corner clips 1202 may be envisioned by one practiced in relevant arts without departing from the scope of the present invention.

Description Conclusion

Figure 13:
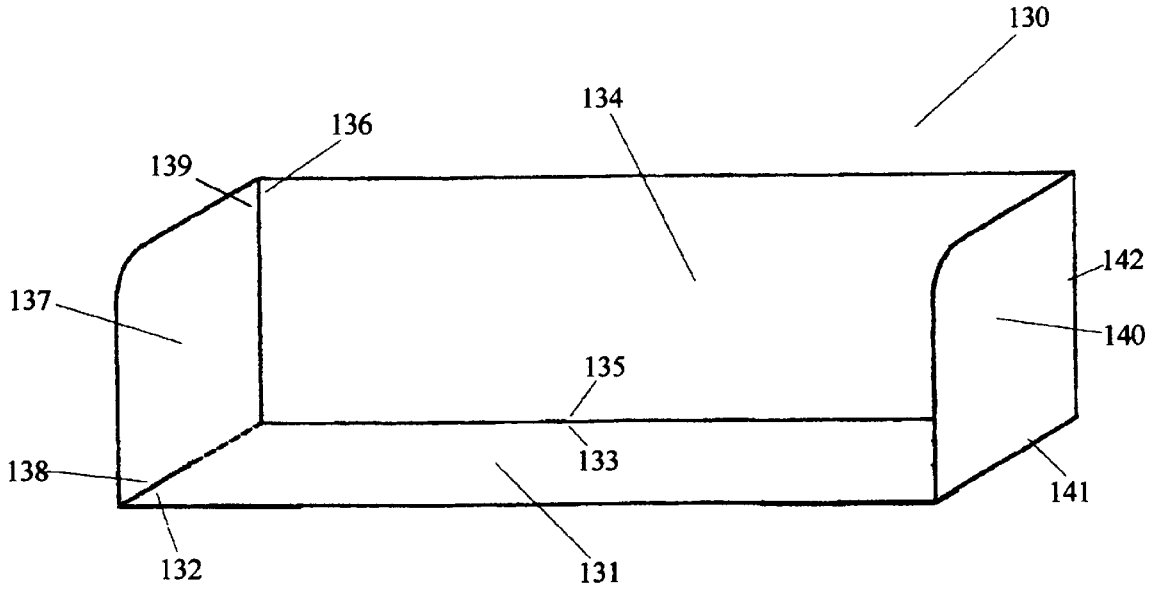
FIG. 13 is a perspective view of a generic embodiment of the subject invention.

Referring now to FIG. 13, a perspective view illustrates a generic embodiment 130 of the subject invention. The various examples described in this specification have a number of fundamental characteristics in common, several of which are depicted in FIG. 13. All of the examples in the specification above describe a desktop bookcase which is a form of open-sided carton, meaning that the preferred embodiment of the desktop bookcase has no front and no top. The absence of a front or top facilitates access to books stored in the desktop bookcase. The generic embodiment 130 of the subject invention, does have a base 131 upon which the stored books rest. The base 131 has a first end edge 132, a second end edge (not shown), and a rear edge 133. The generic embodiment 130 also has aback 134, which has a lower edge 135, a first outer edge 136, and a second outer edge (not shown). At each end of the generic embodiment 130 is a side. A first side 137 has a first bottom edge 138 and a first corner edge 139, and a second side 140 has a second bottom edge 141 and a second corner edge 142.

As described in the various examples, the base, back and sides are connected to one another, and enforced, by a variety of folds, clips, tabs and slots, adhesives, bookends, and/or internal structural reinforcement hardware. Regardless of the characteristics of the individual examples, however, the fundamental similarities depicted by the generic embodiment 130 are still consistent. Also consistent is the fact that the primary assembly of each example is performed by folding a one-piece production blank, geometrically configured so that a described folding process will result in a form of the generic embodiment 130.

The subject invention has been described through a variety of preferred embodiments (examples) with a certain degree of particularity in geometry, materials, and assembly processes. It is understood, however, that the present disclosure of the preferred embodiments have been made only by way of example. Numerous changes in the details with regard to materials, geometry, assembly process and other factors will easily be envisioned by one practiced in a number of relevant arts. Reasonable variation in the selection of materials, the geometry design, and the combination and arrangement of process steps is to be expected, and may be resorted to without departing from the spirit and the scope of the invention as hereinafter claimed.

The invention claimed is:

1. A one-piece production blank, comprising:

a base panel having a rear edge and two end edges;

a back panel having a lower edge and two outer edges, foldably connected to the base panel at an intersection of the lower edge of the back panel and the rear edge of the base panel;

two base side flaps, each having a bottom edge, and each foldably connected to the base panel at an intersection of the bottom edge of the base side flap and an end edge of the base panel;

two back side flaps, each having a corner edge, and each foldably connected to the back panel at an intersection of the corner edge of the back side flap and an outer edge of the back panel;

an additional back panel, foldably connected to the back panel, and configured to be folded flatly onto the back panel;

an additional base panel, foldably connected to the base panel, and configured to be folded flatly onto the base panel; and at least two additional side flaps, each foldably connected to a back side flap, and each configured to be folded flatly onto the back side flap to which it is foldably connected.

2. A one-piece production blank according to claim 1, wherein side flaps are configured to receive internal structural reinforcement.

3. A one-piece production blank according to claim 2, further comprising:

a first panel extension, foldably connected to the back panel; and a second panel extension, foldably connected to the first panel extension;

first and second panel extensions configured so that they produce a raised ledge when first and second panel extensions are perpendicular to one another, and when the base panel and the back panel are perpendicular to one another.

4. An open-sided desktop bookcase, formed by folding a one-piece production blank, comprising:

a base, having a rear edge and two end edges;

a back, having a lower edge and two outer edges, connected to the base at an intersection of the lower edge of the back and the rear edge of the base;

two sides, each having a corner edge and a bottom edge, and each connected to the back at an intersection of the corner edge of each side and an outer edge of the back, and connected to the base at an intersection of the bottom edge of each side and an end edge of the base, each of the two sides comprising multiple thicknesses.

5. An open-sided desktop bookcase according to claim 4, wherein the base and the back each comprise multiple thicknesses.

6. An open-sided desktop bookcase according to claim 5, wherein each side comprises three thicknesses, the back comprises two thicknesses, and the base comprises two thicknesses.

7. An open-sided desktop bookcase according to claim 6, wherein each side is configured to receive internal structural reinforcement.

8. An open-sided desktop bookcase according to claim 7, further comprising a raised ledge attached to the back and supported by the base.

9. An open-sided desktop bookcase, comprising a one-piece production blank geometrically configured to be foldable into an open-sided desktop bookcase, wherein the one-piece production blank comprises:

a base panel having a rear edge and two end edges;

a back panel having a lower edge and two outer edges, foldably connected to the base panel at an intersection of the lower edge of the back panel and the rear edge of the base panel;

two base side flaps, each having a bottom edge, and each foldably connected to the base panel at an intersection of the bottom edge of the base side flap and an end edge of the base panel; and two back side flaps, each having a corner edge, and each foldably connected to the back panel at an intersection of the corner edge of the back side flap and an outer edge of the back panel.

10. An open-sided desktop bookcase according to claim 9, wherein the one-piece production blank further comprises:

an additional back panel, foldably connected to the back panel, and configured to be folded flatly onto the back panel;

an additional base panel, foldably connected to the base panel, and configured to be folded flatly onto the base panel; and at least two additional side flaps, each foldably connected to a back side flap, and each configured to be folded flatly onto the back side flap to which it is foldably connected.

11. An open-sided desktop bookcase according to claim 10, wherein side flaps are configured to receive internal structural reinforcement.

12. An open-sided desktop bookcase according to claim 11, wherein the one-piece production blank further comprises:

a first panel extension, foldably connected to the back panel; and a second panel extension, foldably connected to the first panel extension;

first and second panel extensions configured so that they may produce a raised ledge when first and second panel extensions are perpendicular to one another, and when the base panel and the back panel are perpendicular to one another.

* * * * *